US012759107B2

(12) United States Patent
Xu et al.

(10) Patent No.: US 12,759,107 B2
(45) Date of Patent: Oct. 13, 2026

(54) GENERATION OF BACKGROUND SIGNAL SEQUENCE USING AN IN-SITU MONITORING SYSTEM IN CHEMICAL MECHANICAL POLISHING

(71) Applicant: Applied Materials, Inc., Santa Clara, CA (US)

(72) Inventors: Kun Xu, Sunol, CA (US); Jimin Zhang, San Jose, CA (US); Chen-Wei Chang, San Jose, CA (US); Haosheng Wu, San Jose, CA (US); Patrick A. Higashi, Hacienda Heights, CA (US); Jianshe Tang, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 310 days.

(21) Appl. No.: 18/582,553

(22) Filed: Feb. 20, 2024

(65) Prior Publication Data

US 2025/0262714 A1 Aug. 21, 2025

(51) Int. Cl.
*B24B 37/013* (2012.01)

(52) U.S. Cl.
CPC ..... *B24B 37/013* (2013.01)

(58) Field of Classification Search
None
See application file for complete search history.

(56) References Cited

U.S. PATENT DOCUMENTS 4,753,049 A 6/1988 Mori
4,984,392 A 1/1991 Sekigawa et al.
5,559,428 A 9/1996 Li et al.
6,159,073 A 12/2000 Wiswesser et al.
6,399,501 B2 6/2002 Birang et al.
6,407,546 B1 6/2002 Le et al.
6,433,541 B1 8/2002 Lehman et al.
6,489,624 B1 12/2002 Ushio et al.
6,924,641 B1 8/2005 Hanawa et al.
6,975,107 B2 12/2005 Hanawa et al.
7,112,960 B2 9/2006 Miller et al.
7,153,185 B1 12/2006 Birang et al.
7,519,448 B2 4/2009 Ikeda et al.
(Continued)

OTHER PUBLICATIONS

International Search Report and Written Opinion in International Appln. No. PCT/US2025/012677, mailed on May 13, 2025, 10 pages.

*Primary Examiner* — Peter J Macchiarolo
*Assistant Examiner* — Jermaine L Jenkins
(74) *Attorney, Agent, or Firm* — Fish & Richardson P.C

(57) ABSTRACT

A polishing control technique includes storing data representing a sequence of background traces generated by a sequence of scans of a sensor of an in-situ monitoring system across a substrate, and polishing a layer on a substrate. The layer is monitored during the polishing with the in-situ monitoring system, including repeatedly sweeping the sensor of the in-situ monitoring system across substrate such that each sweep provides a measured trace. For each measured trace, a respective background trace that has an equivalent position in the sequence of background traces is subtracted from the measured trace to generate a modified trace, and a sequence of estimated thickness values is generated based on the modified traces. A polishing endpoint is detected or a polishing parameter is modified based on the sequence of estimated thickness values.

20 Claims, 16 Drawing Sheets

(56) References Cited

U.S. PATENT DOCUMENTS

| | | | |
|---|---|---|---|
| 8,284,560 | B2 | 10/2012 | Iravani et al. |
| 11,260,496 | B2 * | 3/2022 | Yagi ..... B24B 49/105 |
| 11,282,755 | B2 | 3/2022 | Lau et al. |
| 11,869,815 | B2 | 1/2024 | Lau et al. |
| 2001/0008827 | A1 | 7/2001 | Kimura et al. |
| 2002/0019198 | A1 | 2/2002 | Kamono |
| 2003/0139123 | A1 | 7/2003 | Somekh |
| 2004/0067718 | A1 | 4/2004 | Shimizu et al. |
| 2004/0152310 | A1 | 8/2004 | Swedek et al. |
| 2004/0259470 | A1 | 12/2004 | Swedek et al. |
| 2006/0222236 | A1 | 10/2006 | Osada et al. |
| 2007/0205765 | A1 | 9/2007 | Bailey, III |
| 2008/0064300 | A1 | 3/2008 | Swedek et al. |
| 2009/0142992 | A1 | 6/2009 | Takahashi et al. |
| 2009/0156098 | A1 | 6/2009 | Swedek et al. |
| 2010/0099334 | A1 | 4/2010 | Bennett |
| 2010/0217430 | A1 | 8/2010 | David et al. |
| 2011/0124269 | A1 | 5/2011 | Tada et al. |
| 2011/0189925 | A1 | 8/2011 | Iravani et al. |
| 2011/0256805 | A1 | 10/2011 | David et al. |
| 2012/0276661 | A1 | 11/2012 | Iravani et al. |
| 2013/0237128 | A1 | 9/2013 | David et al. |
| 2013/0280827 | A1 | 10/2013 | Benvegnu et al. |
| 2014/0020829 | A1 | 1/2014 | Chen et al. |
| 2014/0242883 | A1 | 8/2014 | Cherian et al. |
| 2015/0118766 | A1 | 4/2015 | Xu et al. |
| 2015/0194356 | A1 | 7/2015 | Xu et al. |
| 2015/0224623 | A1 | 8/2015 | Xu et al. |
| 2016/0018815 | A1 | 1/2016 | Kitajima et al. |
| 2016/0020157 | A1 | 1/2016 | Kitajima et al. |
| 2016/0074989 | A1 | 3/2016 | Fukushima et al. |
| 2018/0203090 | A1 | 7/2018 | Xu et al. |
| 2018/0304435 | A1 | 10/2018 | Xu et al. |
| 2019/0299356 | A1 | 10/2019 | Xu et al. |
| 2021/0066142 | A1 | 3/2021 | Lau et al. |
| 2021/0379723 | A1 | 12/2021 | Xu et al. |
| 2021/0402551 | A1 | 12/2021 | Xu et al. |
| 2022/0208621 | A1 | 6/2022 | Lau et al. |
| 2022/0281059 | A1 | 9/2022 | Li et al. |
| 2023/0390884 | A1 | 12/2023 | Wiswell et al. |
| 2024/0014080 | A1 | 1/2024 | Xu et al. |

* cited by examiner

GENERATION OF BACKGROUND SIGNAL SEQUENCE USING AN IN-SITU MONITORING SYSTEM IN CHEMICAL MECHANICAL POLISHING

TECHNICAL FIELD

The present disclosure relates to in-situ monitoring during polishing of a substrate.

BACKGROUND

An integrated circuit is typically formed on a substrate (e.g. a semiconductor wafer) by the sequential deposition of conductive, semiconductive or insulative layers on a silicon wafer, and by the subsequent processing of the layers.

One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization may be used to planarize the substrate surface for lithography.

Chemical mechanical polishing (CMP) is one accepted method of planarization. This planarization method typically requires that the substrate be mounted on a carrier head. The exposed surface of the substrate is placed against a rotating polishing pad. The carrier head provides a controllable load on the substrate to push it against the polishing pad. A polishing liquid, such as slurry with abrasive particles, is supplied to the surface of the polishing pad.

One problem in CMP is determining whether the polishing process is complete, i.e., whether a substrate layer has been planarized to a desired flatness or thickness, or when a desired amount of material has been removed. Variations in the slurry composition, the polishing pad condition, the relative speed between the polishing pad and the substrate, the initial thickness of the substrate layer, and the load on the substrate can cause variations in the material removal rate. These variations cause variations in the time needed to reach the polishing endpoint. Therefore, determining the polishing endpoint merely as a function of polishing time can lead to non-uniformity within a wafer or from wafer to wafer.

In some systems, a substrate is monitored in-situ during polishing, e.g., through the polishing pad. For example, optical sensors may be used for in-situ monitoring of the substrate. Alternately (or in addition), an eddy current sensing system may be used to induce eddy currents in a conductive layer. In either case, the signal from the sensor can be used to determine the thickness of the layer on the substrate during polishing.

SUMMARY

In one aspect, data is stored representing a sequence of background traces generated by a sequence of scans of a sensor of an in-situ monitoring system across a substrate prior to or after polishing of a layer on the substrate. For each respective sweep of a plurality of sweeps of a sensor of an in-situ monitoring system across the substrate during polishing of the substrate, a sequence of raw signal values is received that provides a measured trace for the respective sweep in a sequence of measured traces. For each respective measured trace in the sequence of measured traces, a respective background trace that has an equivalent position in the sequence of background traces is subtracted from the respective measured trace to generate a modified trace and thus provide a sequence of modified traces. A sequence of estimated thickness values is generated based on the sequence of modified traces, and a polishing endpoint is detected or a polishing parameter is modified based on the sequence of estimated thickness values.

In another aspect, an angular orientation of a calibration substrate is measured, a carrier head holding the calibration substrate is rotated to a first predetermined angular position based on the measured angular orientation, and a platen is rotated to a second predetermined angular position. The calibration substrate is brought into contact with a polishing pad on the platen with calibration substrate at the first predetermined angular position and the platen at the second predetermined angular position. The platen and the carrier head are rotated with the calibration substrate in contact with the polishing pad. The calibration substrate is monitored by sweeping a sensor of an in-situ monitoring system across the calibration substrate to generate a sequence of reference traces with each respective reference trace of the sequence of reference traces corresponding to a respective sweep of a sequence of sweeps by the sensor, and with each reference trace including a series of signal values. The sequence of reference traces is stored and each reference trace is labelled to distinguish an order of the reference traces within the sequence.

Certain implementations can include one or more of the following advantages. An in-situ monitoring system, e.g., an eddy current monitoring system, can generate a signal as one or more sensors scan across a substrate. The system can place the substrate notch and the sensor at predetermined desired angular positions, so that the relative positioning of the sensor and the substrate notch is consistent before each polishing process commences. A consistent starting angular position can improve the likelihood that the sensor will follow a consistent series of paths across the substrate on a wafer-to-wafer basis. Consequently, this system can enhance measurement accuracy by subtracting a signal representing a scan of an underlying layer from the measured signals on a per-scan-path basis. The modified signal, in turn, can be used for a more accurate thickness calculation. This can improve end point control and improve adjustment of polishing parameters to reduce within-wafer non-uniformity (WIWNU) and water-to-wafer non-uniformity (WTWNU).

The details of one or more implementations are set forth in the accompanying drawings and the description below. Other aspects, features and advantages will be apparent from the description and drawings, and from the claims.

BRIEF DESCRIPTION OF DRAWINGS

Like reference symbols in the various drawings indicate like elements.

DETAILED DESCRIPTION

Figure 1:
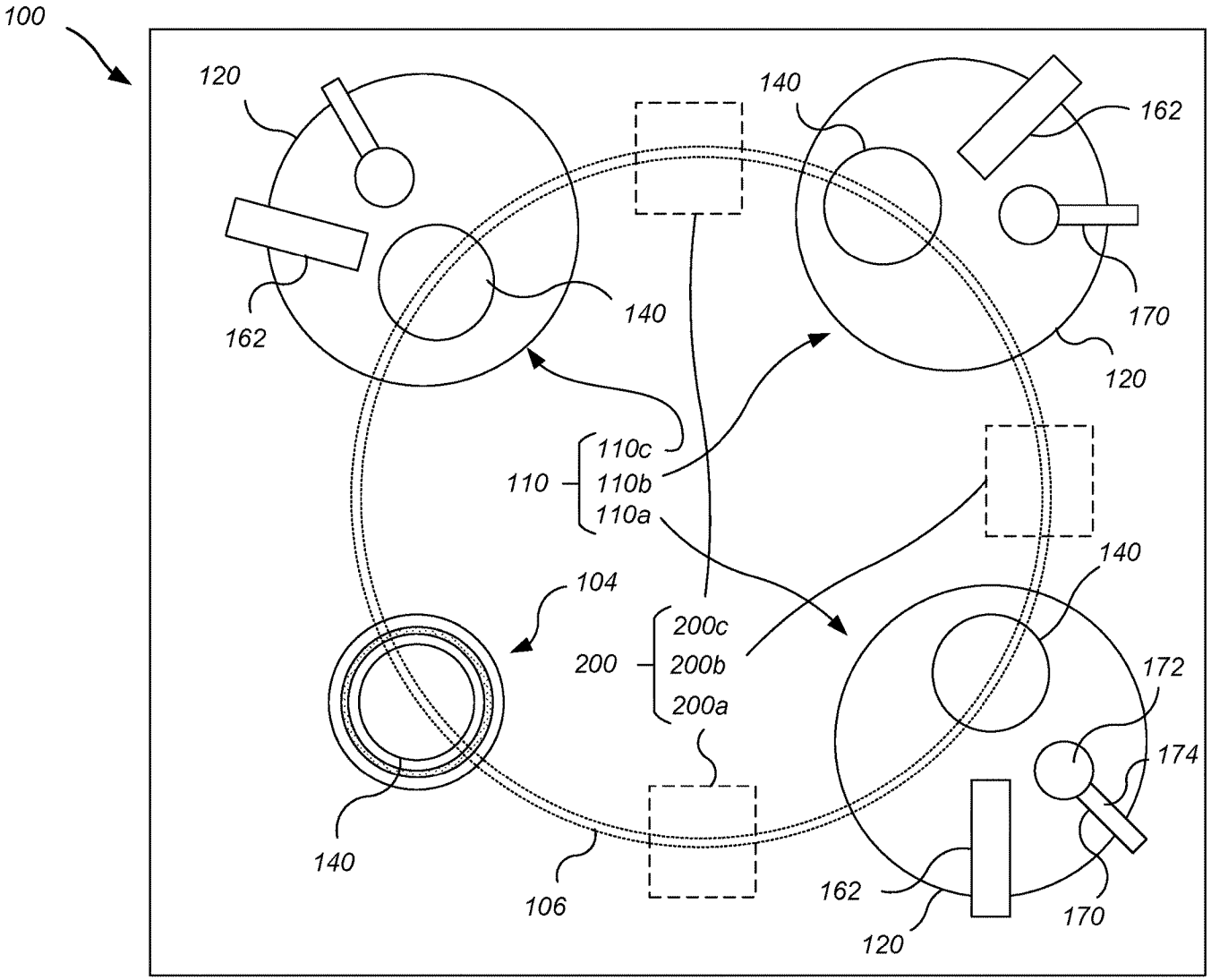
FIG. 1 is a schematic plan view of an example of a polishing apparatus.

A polishing apparatus can use an in-situ monitoring system, e.g., an eddy current monitoring system, to detect the thickness of an outer layer that is being polished on a substrate. During polishing of the outer layer, the in-situ monitoring system can determine the thickness of different locations of the layer on the substrate. The thickness measurements can be used to trigger a polishing endpoint and/or to adjust processing parameters of the polishing process in real time. For example, a substrate carrier head can adjust the pressure on the backside of the substrate to increase or decrease the polishing rate of the locations of the outer layer. The polishing rate can be adjusted so that the locations of the layer are substantially the same thickness after polishing. The CMP system can adjust the polishing rate so that polishing of the locations of the layer completes at about the same time. Such profile control can be referred to as real time profile control (RTPC).

An in-situ monitoring system, e.g., an eddy current monitoring system, can be subject to signal distortion due to noise originating from the underlying layers. For example, underlying metal layers with high conductivity can generate unwanted contribution to the signal measured by the eddy current sensor, which interferes with the monitoring of the conductive layer of primary interest. In particular, as compared to polishing of "blank" wafers, during polishing of a patterned wafer used for integrated circuit device fabrication, the sensor scans across regions with differing density and arrangement of metal features, resulting in variation in the signal. Moreover, this problem grows worse as the number of metal layers in the device substrate increase. In addition, because each scan of the sensor across the substrate can follow a different path, the signal varies from scan-to-scan. This heightened noise relative to the signal can introduce noise into the calculation of layer thickness. This reduces the precision of controlling polishing parameters, e.g. endpoint and/or polishing rate, and consequently result in large WIWNU and WIWNU. To mitigate this issue, the system can utilize methods such as scan signal averaging to reduce noise. However, there are situations where this method is ineffective, particularly when the variation from one scan to another exceeds the signal of the film of interest.

A technique to address this issue is to align each substrate consistently to a specific angular orientation relative to the eddy current sensor before commencing the chemical mechanical polishing process. Maintaining this consistent starting angular orientation increases the likelihood that the sensor will follow a repeatable path while scanning each substrate. The scan-to-scan variation can be reduced by subtracting the underlayer noise from the measure signals on a per-scan-path basis. As a result, film thickness monitoring precision is enhanced, benefiting both within-wafer uniformity (WIWU) and wafer-to-wafer uniformity (WTWU).

Polishing Station

FIG. 1 is a plan view of a chemical mechanical polishing apparatus 100 for processing one or more substrates. The polishing apparatus 100 includes a plurality of polishing stations 110. For example, the polishing apparatus can include three polishing stations 110*a*, 110*b*, and 110*c*. The polishing apparatus 100 also includes at least one carrier head 140, e.g., four carrier heads 140. The polishing apparatus 100 also includes a transfer station 104 for loading and unloading substrates from the carrier heads 140. The stations of the polishing apparatus 100, including the transfer station 104 and the polishing stations 110, can be positioned at substantially equal angular intervals around the center of the platform.

Figure 2:
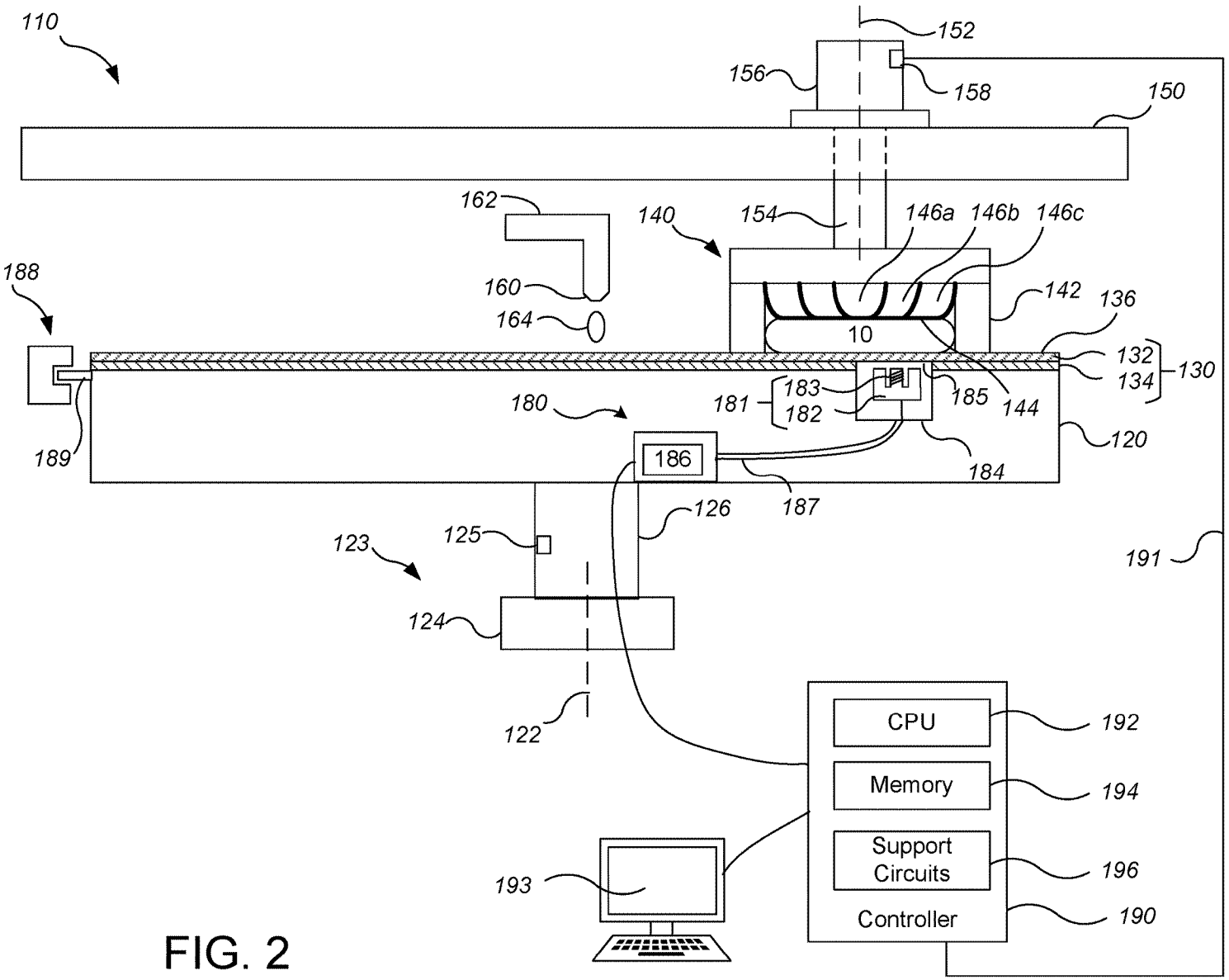
FIG. 2 is a schematic side view, partially cross-sectional, of a chemical mechanical polishing station that includes an eddy current monitoring system.

Referring to FIG. 2, each polishing station 110 includes a polishing pad 130 supported on a rotatable platen 120. The polishing pad 130 can be a two-layer polishing pad with an outer polishing layer 132 and a softer backing layer 134 (see FIG. 2). A top surface of the polishing layer 132 can provide a polishing surface 136.

Returning to FIG. 1, for a polishing operation, one carrier head 140 can be positioned at each polishing station 110. Another additional carrier head 140 can be positioned in the transfer station 104 to exchange a polished substrate for an unpolished substrate while the other substrates are being polished at the polishing stations 110.

The carrier heads 140 are held by a support structure, e.g., a rotatable carousel or a carriage suspended from a track, that can cause carrier head to move along a 106 path that passes, in order, each polishing station 110*a*-110*c* and the transfer station 104.

Referring to FIGS. 1 and 2, each polishing station 110 can include a port 160, e.g., at the end of an arm 162, to dispense polishing liquid 164, such as abrasive slurry, onto the polishing pad 130. Each polishing station 110 of the polishing apparatus 100 can also include pad conditioning apparatus 170 to abrade the polishing pad 130 to maintain the polishing surface 136 in a consistent abrasive state. For example, the conditioning apparatus can include a conditioning head 172 with a conditioning disk at the end of an arm 174.

As shown in FIG. 2, the platen 120 at each platen 120 is operable to rotate about an axis 122. For example, a motor 124 can turn a drive shaft 126 to rotate the platen 120. Each motor 124 can include an encoder 125 that measures the angular position or rotation rate of the associated drive shaft 126. The associated drive shafts can have respective reference angular positions that are recognized by the encoder 125 to measure the number of revolutions of the drive shafts.

Each carrier head 140 is operable to hold a substrate 10 against the polishing pad 130. Each carrier head 140 can include a retaining ring 142 to retain the substrate 10 below a flexible membrane 144. Each carrier head 140 can also include a plurality of independently controllable pressurizable chambers defined by the membrane, e.g., three chambers 146*a*-146*c*, which can apply independently controllable pressurizes to associated zones on the flexible membrane 144 and thus on the substrate 10. Although only three chambers are illustrated in FIG. 2 for ease of illustration, there could be one or two chambers, or four or more chambers, e.g., five chambers.

Each carrier head 140 is suspended from the support structure 150, and is connected by a drive shaft 154 to a carrier head rotation motor 156 so that the carrier head can rotate about an axis 152. Optionally each carrier head 140 can oscillate laterally, e.g., driven by a carriage on the track, by a motor that oscillates the carrier head radially, or by rotational oscillation of the carousel itself.

In operation, the platen is rotated about its central axis, and each carrier head is rotated about its central axis 152 and translated laterally across the top surface of the polishing pad.

An in-situ monitoring system can include an in-situ monitoring system 180 installed in the platen 120 to monitor the progress of the polishing operation and/or measure a thickness of the layer on the substrate 10 that is being polished. The in-situ monitoring system 180 can use an optical sensor, e.g., a spectrometer, an eddy current sensor, a capacitive sensor, a friction sensor, etc.

A controller 190, such as a programmable computer, is connected to each motor 124, 156 to independently control the rotation rate of the platen 120 and the carrier heads 140. For example, each motor 156 can include an encoder 158 that measures the angular position or rotation rate of the associated drive shaft 154. The associated drive shafts can have respective reference angular positions that are recognized by the encoder 158 to measure the number of revolutions of the drive shafts.

The controller 190 is also connected to pressure regulators to control the pressures in the chambers 146*a*-146*c*. In particular, the controller 190 can be configured to receive thickness measurements from the in-situ monitoring system and control the pressures in the chambers 146*a*-146*c* to provide improved polishing uniformity.

The controller 190 can include a central processing unit (CPU) 192, a memory 194, and support circuits 196, e.g., input/output circuitry, power supplies, clock circuits, cache, and the like. The memory is connected to the CPU 192. The memory is a non-transitory computable readable medium, and can be one or more readily available memory such as random access memory (RAM), read only memory (ROM), floppy disk, hard disk, or other form of digital storage. In addition, although illustrated as a single computer, the controller 190 could be a distributed system, e.g., including multiple independently operating processors and memories.

Eddy Current Monitoring System

The in-situ-monitoring system can be an eddy current monitoring system 180. The eddy current monitoring system 180 includes a drive system to induce eddy currents in a conductive layer on the substrate and a sensing system to detect eddy currents induced in the conductive layer by the drive system. The eddy current monitoring system 180 includes a core 182 positioned in a recess 184 to rotate with the platen, at least one coil 183 wound around a portion of the core 181, and drive and sense circuitry 186 connected by wiring 187 to the coil 183. The combination of the core 182 and coil 183 can provide a sensor head 181. In some implementations, the core 182 can project above the top surface of the platen 120, e.g., into a recess 185 in the bottom of the polishing pad 130.

The drive and sense circuitry 186 is configured to apply an oscillating electric signal to the coil 187 and to measure the resulting eddy current. A variety of configurations are possible for the drive and sense circuitry and for the configuration and position of the coil(s), e.g., as described in U.S. Pat. Nos. 6,924,641, 7,112,960 and 8,284,560, and in U.S. Patent Publication Nos. 2011-0189925 and 2012-0276661. The drive and sense circuitry 186 can be located in the same recess 183 or a different portion of the platen 120, or could be located outside the platen 120 and be coupled to the components in the platen through a motor 124.

In operation the drive and sense circuitry 186 drives the coil 183 to generate an oscillating magnetic field. At least a portion of magnetic field extends through the polishing pad 130 and into substrate 10. If a conductive layer is present on substrate 10, the oscillating magnetic field generates eddy currents in the conductive layer. The eddy currents cause the conductive layer to act as an impedance source that is coupled to the drive and sense circuitry 186. As the thickness of the conductive layer changes, the impedance changes, and this can be detected by the drive and sense circuitry 186.

Alternatively or in addition, an optical monitoring system, which can function as a reflectometer or interferometer, can be secured to the platen 120 in the recess 184. If both systems are used, the optical monitoring system and eddy current monitoring system can monitor the same portion of the substrate.

The polishing stations 110 can also include a position sensor 188, such as an optical interrupter, to sense when the sensor head 181 is beneath the substrate 10. For example, the optical interrupter could be mounted at a fixed point opposite the carrier head 140. A flag 189 is attached to the periphery of the platen. The point of attachment and length of flag 189 is selected so that it interrupts the optical signal of sensor 188 while the sensor head 181 sweeps beneath substrate 10.

The signals can pass from the eddy current monitoring system 180 to the controller 190 through the rotary electrical union 123. Alternatively, the circuitry 186 could communicate with the controller 190 by a wireless signal.

Since the sensor head 181 sweeps beneath the substrate with each rotation of the platen, information on the conductive layer thickness is accumulated in-situ and on a continuous real-time basis (once per platen rotation). The controller 190 can be programmed to sample measurements from the monitoring system 180 when the substrate 10 generally overlies the sensor head 181 (as determined by the position sensor). The measurements from the monitoring systems can be displayed on the output device 193 during polishing to permit the operator of the device to visually monitor the progress of the polishing operation, although this is not required.

Assuming the thickness of the layer varies across the substrate, the change in the position of the sensor head with respect to the substrate 10 can result in a change in the signal from the in-situ monitoring system 160. The time varying sampled signal resulting from a single sweep of the sensor below the substrate may be referred to as a trace. So variation in the signal across a trace can indicate variation in the layer thickness across the substrate. In addition, as polishing progresses, the thickness of the conductive layer changes, and the sampled signals vary with time. So trace-to-trace differences can indicate variation in the layer thickness over time.

In operation, the polishing stations 110 can use the eddy current monitoring system 180 to determine when the bulk of the filler layer has been removed and/or to determine when an underlying layer has been substantially exposed. Possible process control and endpoint criteria for the detector logic include local minima or maxima, changes in slope, threshold values in amplitude or slope, or combinations thereof.

The controller 190 can be programmed to divide the measurements from the eddy current monitoring system 180 from each sweep beneath the substrate into a plurality of sampling zones, to calculate the radial position of each sampling zone, and to sort the amplitude measurements into radial ranges, as discussed in U.S. Pat. No. 6,399,501. After sorting the measurements into radial ranges, information on the film thickness can be fed in real-time into a closed-loop controller to periodically or continuously modify the polishing pressure profile applied by a carrier head in order to provide improved polishing uniformity.

Figure 4A:
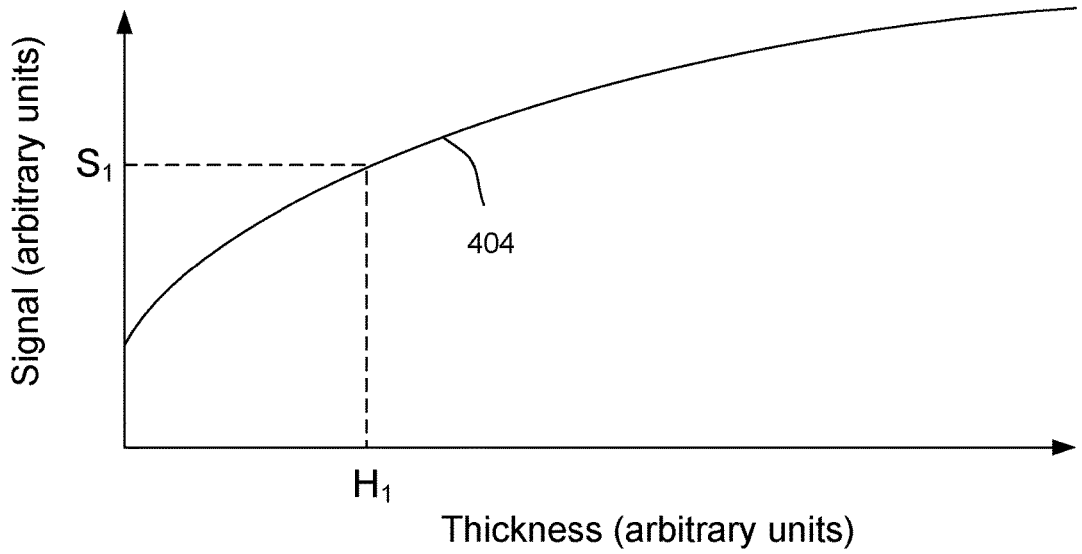
FIG. 4A is a schematic graph of a static formula for determining substrate thickness based on measured signals.

The controller 190 can use a correlation curve that relates the signal measured by the in-situ monitoring system 180 to the thickness of the layer being polished on the substrate 10 to generate an estimated measure of the thickness of the layer being polished. An example of a correlation curve 404 is shown in FIG. 4A. In the coordinate system depicted in FIG. 4A, the horizontal axis represents the value of the signal received from the in-situ monitoring system 180, whereas the vertical axis represents the value for the thickness of the layer of the substrate 10. For a given signal value, the controller 190 can use the correlation curve 404 to generate a corresponding thickness value. The correlation curve 404 can be considered a "static" formula, in that it predicts a thickness value for each signal value regardless of the time or position at which the sensor head obtained the signal. The correlation curve can be represented by a variety of functions, such as a polynomial function, or a look-up table (LUT) combined with linear interpolation.

Figure 5A:
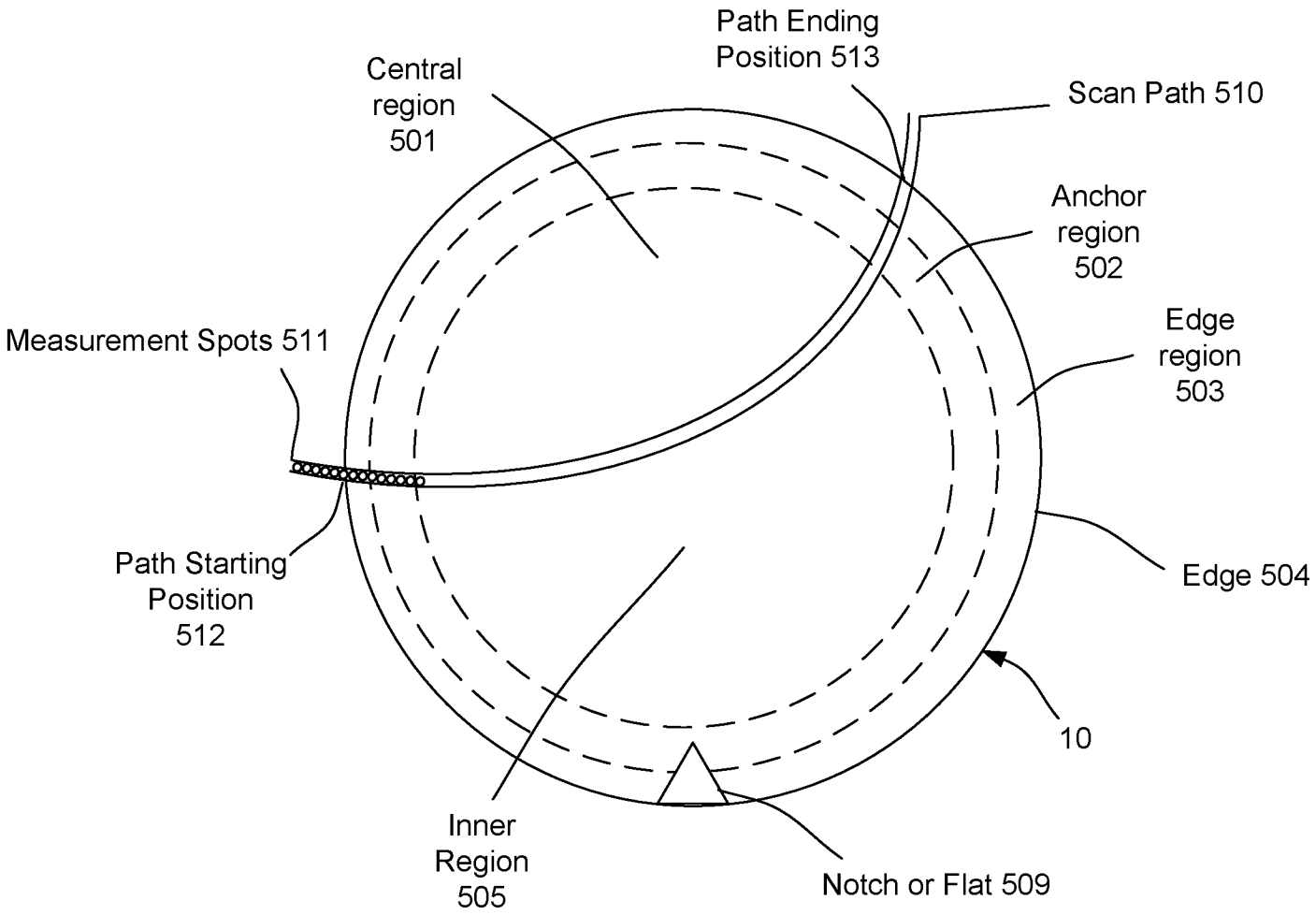
FIG. 5A is a schematic top view of a substrate being scanned by a sensor head of a polishing apparatus for a single pass.
Figure 5B:
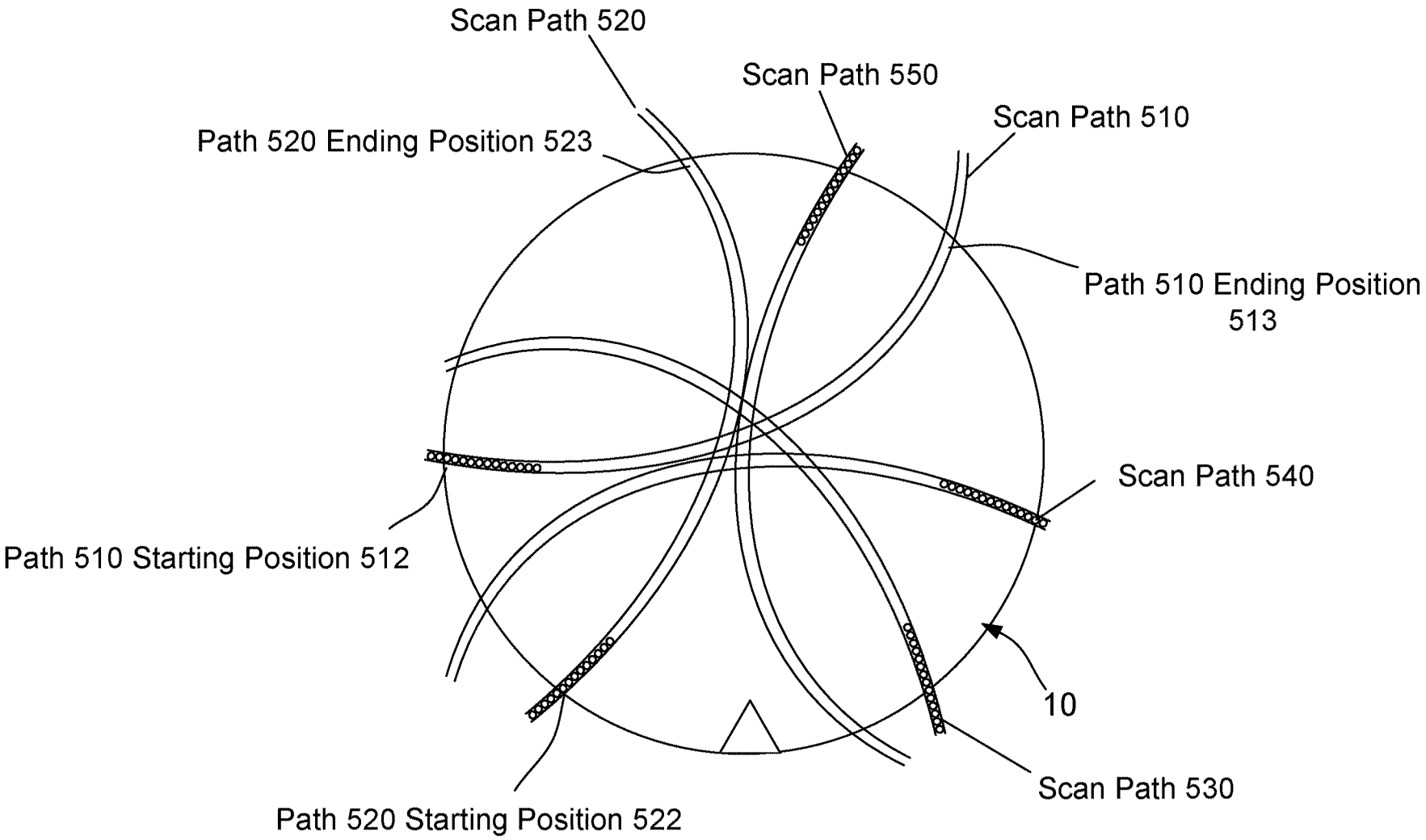
FIG. 5B is a schematic top view of a substrate being scanned by a sensor head of a polishing apparatus for multiple passes.
Figure 5C:
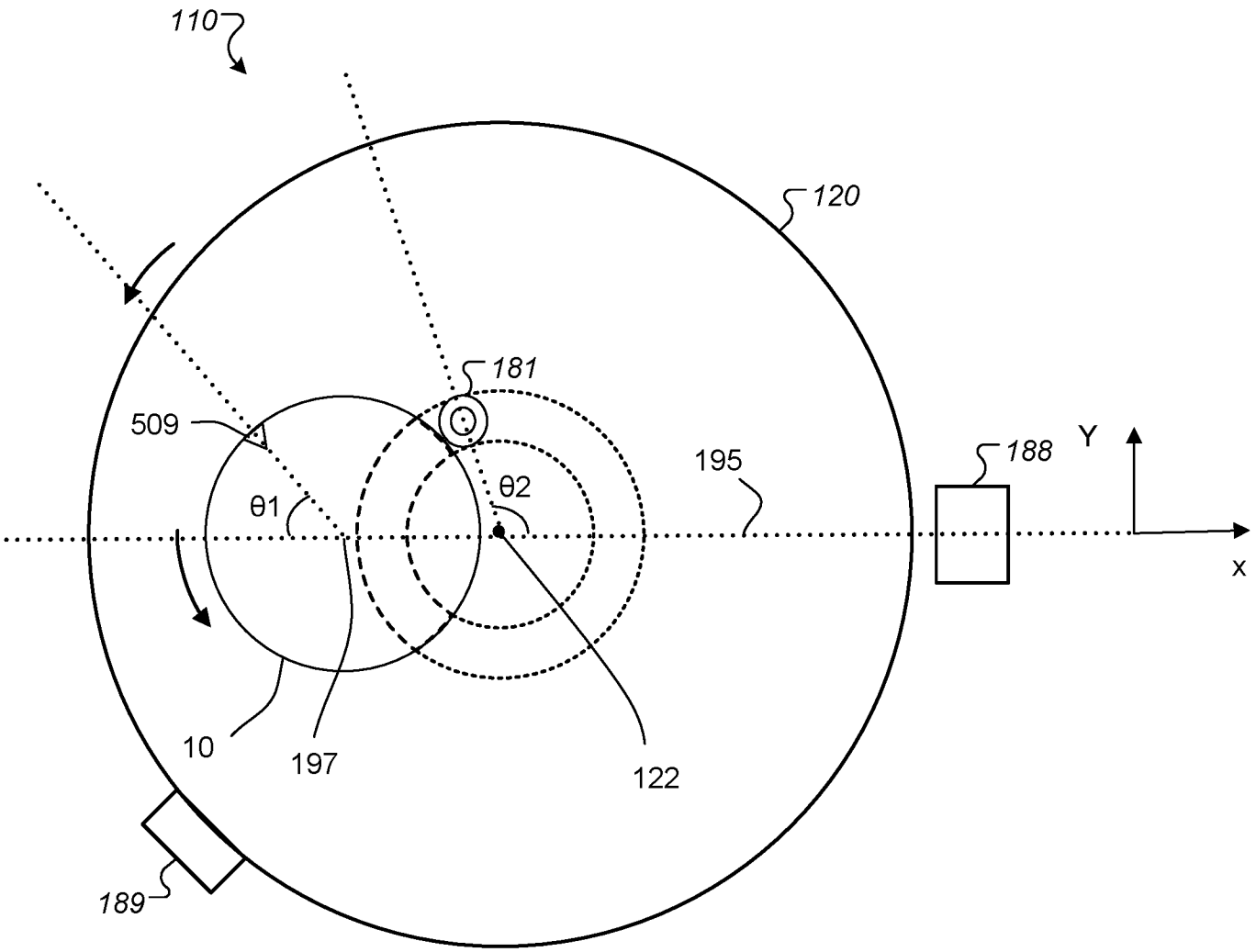
FIG. 5C is a schematic top view of relative angular positions of a substrate and a platen.
Figure 5D:
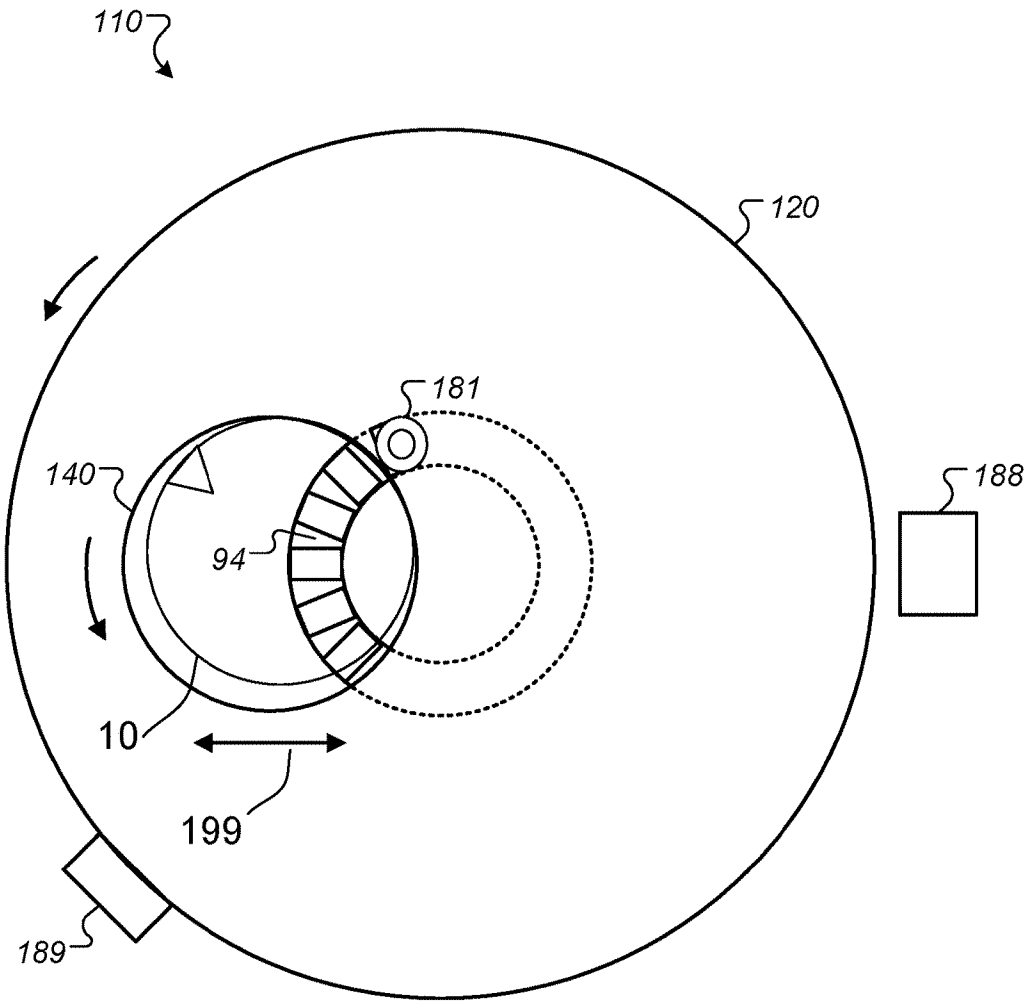
FIG. 5D is a schematic top view of oscillations between a substrate and its carrier head during a polishing process.

Referring to FIG. 5D, changes in the position of the sensor head with respect to the substrate 10 can result in a change in the signal from the in-situ monitoring system 180. That is, as the sensor head scans across the substrate 10, the in-situ monitoring system 180 will make measurements for multiple regions 94, e.g., measurement spots, at different locations on the substrate 10.

Notch Finder Station

Figure 3:
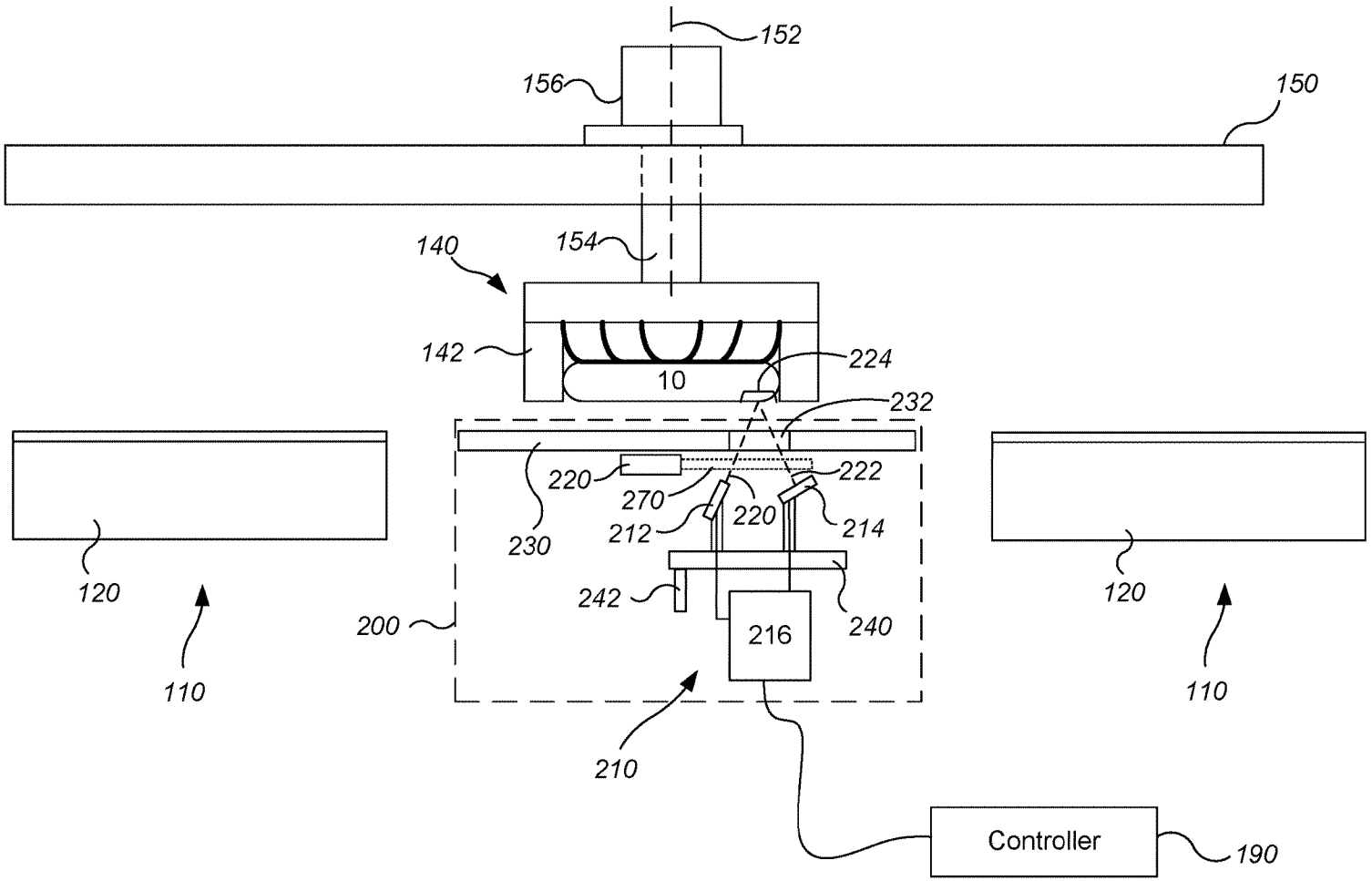
FIG. 3 is a schematic side view of an example of an inter-platen notch finder.

Referring to FIGS. 1, and 3, the polishing apparatus 100 can also include one or more notch-finding stations 200. In some implementations, a notch-finding station 200*a* is positioned on the path 106 at a spot between the transfer station 104 and a first polishing station, e.g., polishing station 110*a*. One or more notch-finding stations 200*b*, 200*c* can be positioned on the path 106 travelled by the carrier heads 140 between two polishing stations 200.

In some implementations, the polishing system includes two inter-platen notch-finding stations 200*b*, 200*c*. The two inter-platen notch-finding stations 200*b*, 200*c* could be on the path 106 on opposite sides of a polishing station, e.g., the second polishing station 110*b*.

In some modes of operation, the substrate orientation is measured at a notch-finding station 200 located before a polishing station 110 along the path 106, and then moved forward along the path 106 to the polishing station 110 and polished at that polishing station 110. However, in some modes of operation, the substrate orientation can be measured at a notch-finding station 200 located after a polishing station 110 along the path 106, and then moved backward along the path 106 to the polishing station 110 and polished at that polishing station 110. The substrate can then be moved forward again along the path 106 to the next polishing station, optionally stopping at the notch-finding station 200 before being polished at the next polishing station.

FIG. 3 illustrates an implementation of a notch finding station 200 positioned between two platens 120 of two polishing stations 110 that are adjacent along the path. This implementation of the notch finding station 200 has an optical notch detector 210 that includes a light source 212, a light detector 214, and circuitry 216 for sending and receiving signals between the controller 190 and the light source 212 and light detector 214. The optical notch detector 210 can also be considered to include some of the functionality implemented, e.g., software, in the controller 190.

The light source 212 is located such that a carrier head 140 can be positioned on the path 106 where the substrate 10 can scanned by the optical notch detector 210. In particular, the light source 212 generates a light beam 220 that can be reflected by the substrate 10, and the light detector 214 is positioned to receive a reflected light beam 222 from the substrate 10. The light detector 214 can be positioned where the light beam 220 and reflected light beam 22 have equal incidence angles, e.g., such that the light detector 214 is receiving reflected (rather than scattered) light. Although FIG. 3 illustrates the light beam 220 travelling in a straight line to the substate 10, one or more mirrors can be positioned in the optical path of the light beam 220.

To operate, the carrier head 140 is positioned in the notch finding station 200 with the substrate 10 positioned above and spaced apart from the optical components of the at the optical notch detector 210. In particular the carrier head 140 is positioned such that the light beam 220 impinges the substrate 10 in an impingement spot 224 that contacts or overlaps the substrate edge 16. The carrier head 140 rotates so that the substrate 10 rotates, thus sweeping the light beam along the circumference of the substrate 10. Since the membrane 144 will have a different reflectivity than the substrate 10, the signal from the detector 214 should change when the notch 12 passes across the light beam 220. The notch position can thus be detected based on variation of the intensity signal from the detector 214.

For some processes, it is useful to have each substrate oriented to a consistent angular position before polishing commences. The wafer notch can be oriented by rotating its carrier head. If the polishing operation has some inherent angular variation, e.g., due to a pattern of features on the substrate, then a consistent starting angular position can improve the ability to compensate for such variation, e.g., by application of varying pressure by the chambers inside the carrier head. In addition, a consistent starting angular position can improve the likelihood that the eddy current monitoring system 180 traces a consistent series of paths across the substrate on a wafer-to-wafer basis, thus making processing of the signal from the in-situ monitoring system more reliable.

Signal Processing

FIG. 5A shows a schematic top view of a substrate being scanned by a sensor head of a polishing apparatus for one scan path 510. The scan path starts at position 512 on the leading edge of the substrate 10 and ends at position 513 on the trailing edge of the substrate 10. As noted above, changes in the position of the sensor head with respect to the substrate 10 can result in a change in the signal from the in-situ monitoring system 180. That is, as the sensor head scans across the substrate 10, the in-situ monitoring system 180 will make measurements for multiple regions, e.g., measurement spots 511, at different locations on the substrate 10.

Figure 4B:
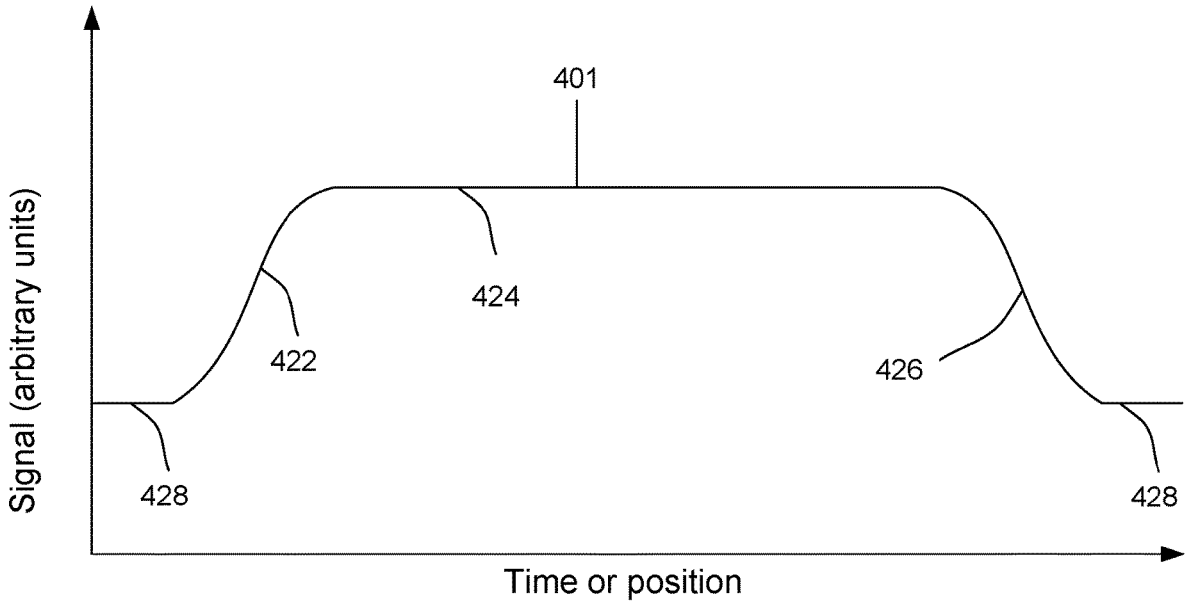
FIG. 4B is a schematic graph of simplified measured signals obtained while monitoring locations on a substrate.

FIG. 4B illustrates a graph (shown for illustration of the process; no graph need be generated or displayed in operation) that shows a simplified signal 401 from the in-situ monitoring system 180 during a single pass of the sensor head below the substrate 10. For a given trace, the signal can be captured (and thus the graph can represent the signal) as a function of measurement time or of position, e.g., radial or diameter position, of the measurement on the substrate. In either case, different portions of the signal 401 correspond to measurement spots 94 at different locations on the substrate 10 scanned by the sensor head. Thus, the graph 420 depicts, for a given location of the substrate scanned by the sensor head, a corresponding measured signal value from the signal 401. Although the signal 401 is illustrated as a continuous line, in practice the signal 401 will be composed of a sequence of individual signal values.

Referring to FIGS. 5A and 4B, the signal 401 includes a first portion 422 that corresponds to locations in an edge region 503 of the substrate 10 when the sensor head crosses a leading edge of the substrate 10, a second portion 424 that corresponds to locations in a central region 501 of the substrate 10, and a third portion 426 that corresponds to locations in edge region 503 when the sensor head crosses a trailing edge of the substrate 10. The signal can also include portions 428 that correspond to off-substrate measurements, i.e., signals generated when the sensor head scans areas beyond the edge 504 of the substrate 10 in FIG. 5A.

The edge region 503 can correspond to a portion of the substrate where measurement spots 94 of the sensor head overlap the substrate edge 504. The sensor head may scan these regions on its path 510 and generate a sequence of measurements that correspond to a sequence of locations along the path 510.

Although the second portion 424 is illustrated as flat, this is for simplicity, and a real signal in the second portion 424 would likely include fluctuations due both to noise and to variations in the layer thickness. The second portion 424 corresponds to the monitoring location scanning the central region 501.

During a polishing process, the sensor conducts multiple scans, with each scan measuring the thickness at various radial positions across the substrate. Due to the differing rotation rate of the carrier head 140 and the platen 120, and due to the lateral oscillation of the carrier head, the scan paths are not consistent. As illustrative in FIG. 5B, the substrate 10 is shown having been scanned by a sensor head along five distinct paths, 510, 520, 530, 540, and 550. Because the multiple scan 510-550 follow distinct paths, they cover areas with differing density and arrangement of metal features, resulting in scan-to-scan variation due to underlayer noise.

Figure 7A:
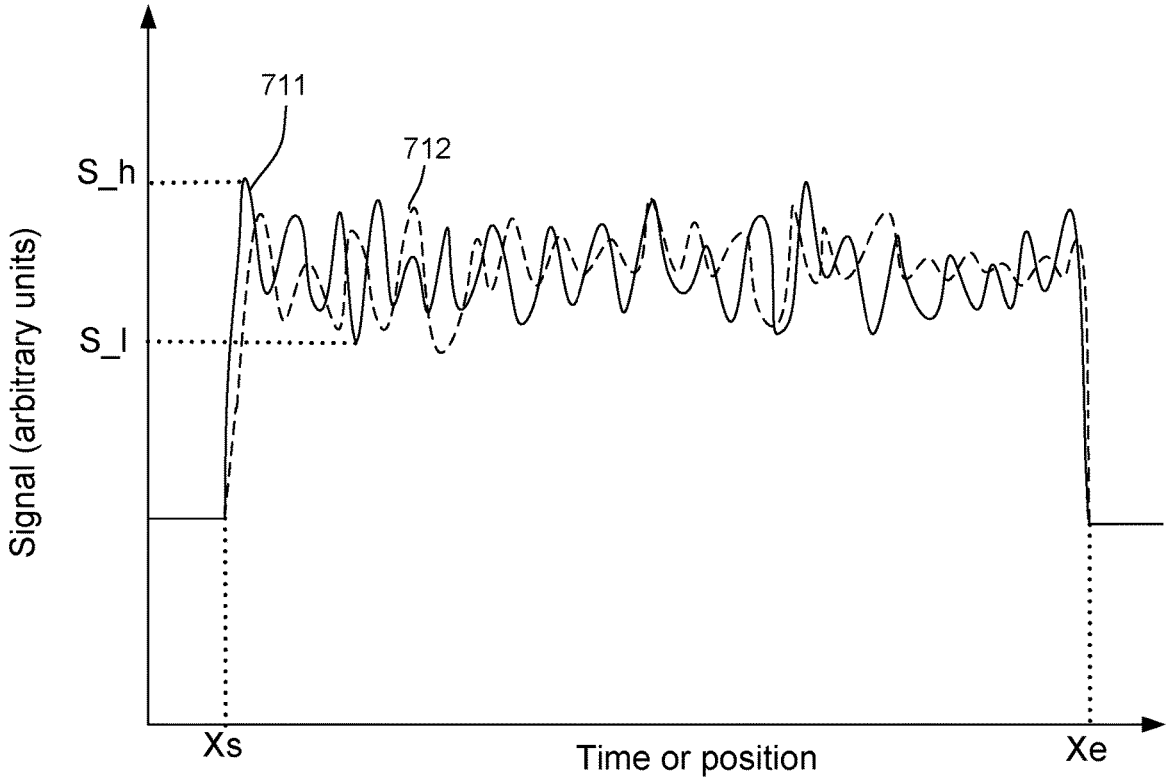
FIG. 7A is a schematic graph of two measured signal traces from two scan paths.

FIG. 7A illustrates a graph (shown for illustration of the process; no graph need be generated or displayed in operation) that shows two traces 711, 712 from the in-situ monitoring system 180 during two passes of the sensor head beneath the substrate 10, with the traces 711, 712 including noise fluctuations. For example, the signal trace 711 could be obtained from the scan path 510, and the signal trace 712 could be obtained from the scan path 520 (see FIG. 5B). As noted above, each trace can be stored as a function of measurement time or of position, e.g., radial position, of the measurement on the substrate. The fluctuation in a single trace 711 or 712 can be due to both variation in the thickness across the substrate of the layer being polished and underlayer noise. On the other hand, the scan-to-scan variation between these traces 711, 712 occurs because the sensor travels along two distinct scan paths, covering different arrangement of underlying metal structures.

Although only two traces are illustrated in FIG. 7A, the system can acquire three or more traces with each trace obtained from a single pass of a sensor. Multiple traces can be obtained through a single sensor with multiple scans, multiple sensors with a single scan, or multiple sensors with multiple scans.

In this example, the scan signal traces 711 and 712 obtained from two distinct scan paths have notable variations: the signal trace 711 displays larger noise fluctuations from the underlayer signals compared to the signal trace 712. However, other variations are possible. As noted above, the difference can be attributed to the distinct scan paths covering areas with varying density and arrangement of underlying metal features. Specifically, in the case of the signal trace 711, S_h corresponds to a peak value, while S_l represents a valley value. The magnitude of signal fluctuation in the signal trace 711 is then given by S_h-S_l.

Figure 7B:
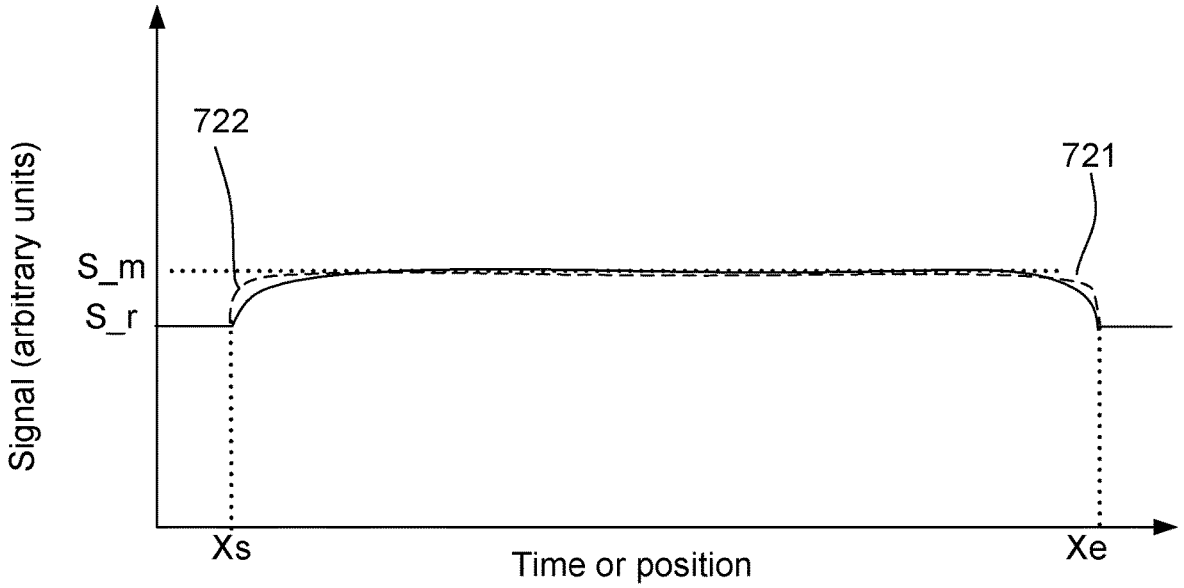
FIG. 7B is a schematic graph of ground-truth measurement from two scan paths.

Referring to FIG. 7B, which is an exemplary graph illustrating a ground truth measurement of a target layer, excluding any influence from underlayers. Ground truth value is often measured through methods such as a four-point probe technique or scanning a calibration wafer containing solely the layer of interest. In particular, for the ground truth signal trace 721, S_m is its mean signal values, while S_r is the signal value reference for off-substrate measurements, i.e., signals generated when the sensor head scans areas beyond the edge 504 of the substrate 10 (see FIG. 5A). Absent underlayer noise, the difference between S_m and S_r provides an accurate measurement of the target layer's thickness.

As illustrated in FIGS. 7A and 7B, the magnitude of noise fluctuations (S_h-S_l) for the measured signal trace 711 can be higher than its ground truth value (S_m-S_r) due to underlayer noises. Consequently, this leads to a substantial noise-to-signal ratio, reducing the accuracy of thickness calculations based on the measured signals.

To address this high noise-to-signal ratio issue, the controller 190 can incorporate a data processing program which subtracts background traces on a scan-by-scan basis. These background traces represent scans of a calibration or test substrate having the same patterning as the substrate undergoing process but immediately before deposition of the conductive layer being polished, or after polishing of the layer until an underlying layer is exposed. That is, the calibration substrate would include all of the same layers, in the same patterning, as the substrate being polished, except for the layer, e.g., the conductive layer, that is to be polished and monitored.

In some implementations, this approach includes sequentially labeling both the measured traces and the background traces, starting from the first scan (e.g., labeled as #1) and progressing through to the final scan at the end of the polishing process (e.g., labeled as #n, where n is the total number of scans conducted during a CMP process). The background trace is subtracted from the measured trace bearing the equivalent label number on a scan-by-scan basis.

Figure 6:
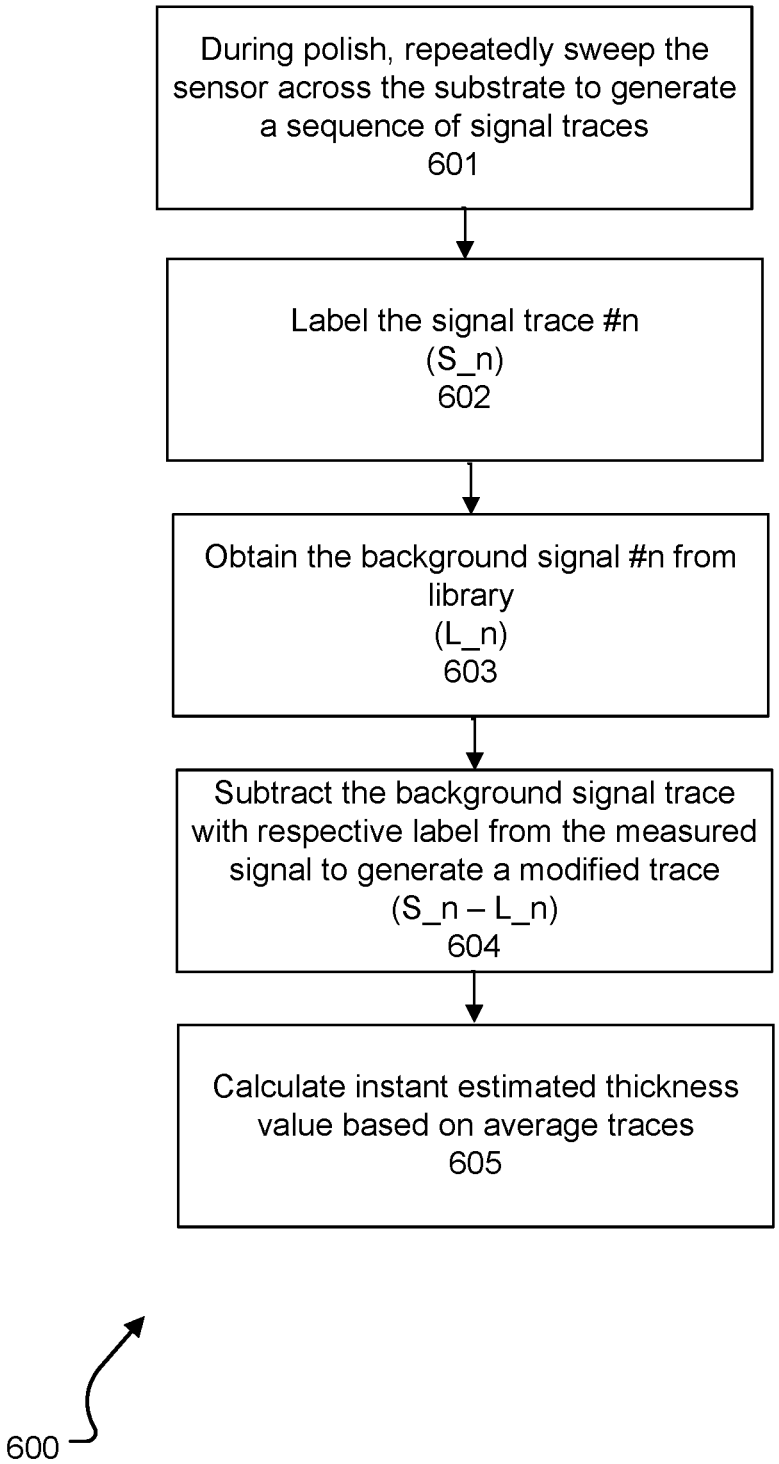
FIG. 6 is a flow diagram of an example process for subtracting background signal traces from measured signal traces on a scan-by-scan basis.

For further illustration, FIG. 6 is a flow-diagram of an example for subtraction of background signal traces from measured signals on a scan-by-scan basis to reduce noises.

During CMP process, the one or more sensors are repeatedly swept (601) across a substrate to generate a sequence of measured traces.

The controller 190 labels (602) the measured trace. In some implementations, the label can be determined based on the ordinal position of the measured trace in the sequence of measured trace. For example, the first measured trace produced during an initial pass of a sensor is assigned the label #1, the second measured trace from the second pass of a sensor is labeled as #2, and so forth, until the polishing process is completed. If there are a total of n sensor scans throughout the entire polishing procedure, the measured traces are labeled from #1 to #n. Referring back to FIG. 7A, the measured trace 711, generated during the scan path 510, can be labeled as #1, whereas the measured trace 712, originating from the scan path 520, can be labeled as #2. Other methods of labeling can be used, so long as it is possible to determine a background trace that occurred at the same scan ordinal position in the sequence of scans as the measured trace.

The controller 190 obtains a (603) corresponding background traces from a digital library. In particular, the controller 190 can obtain the background trace having the same label as the measured trace.

Figure 7C:
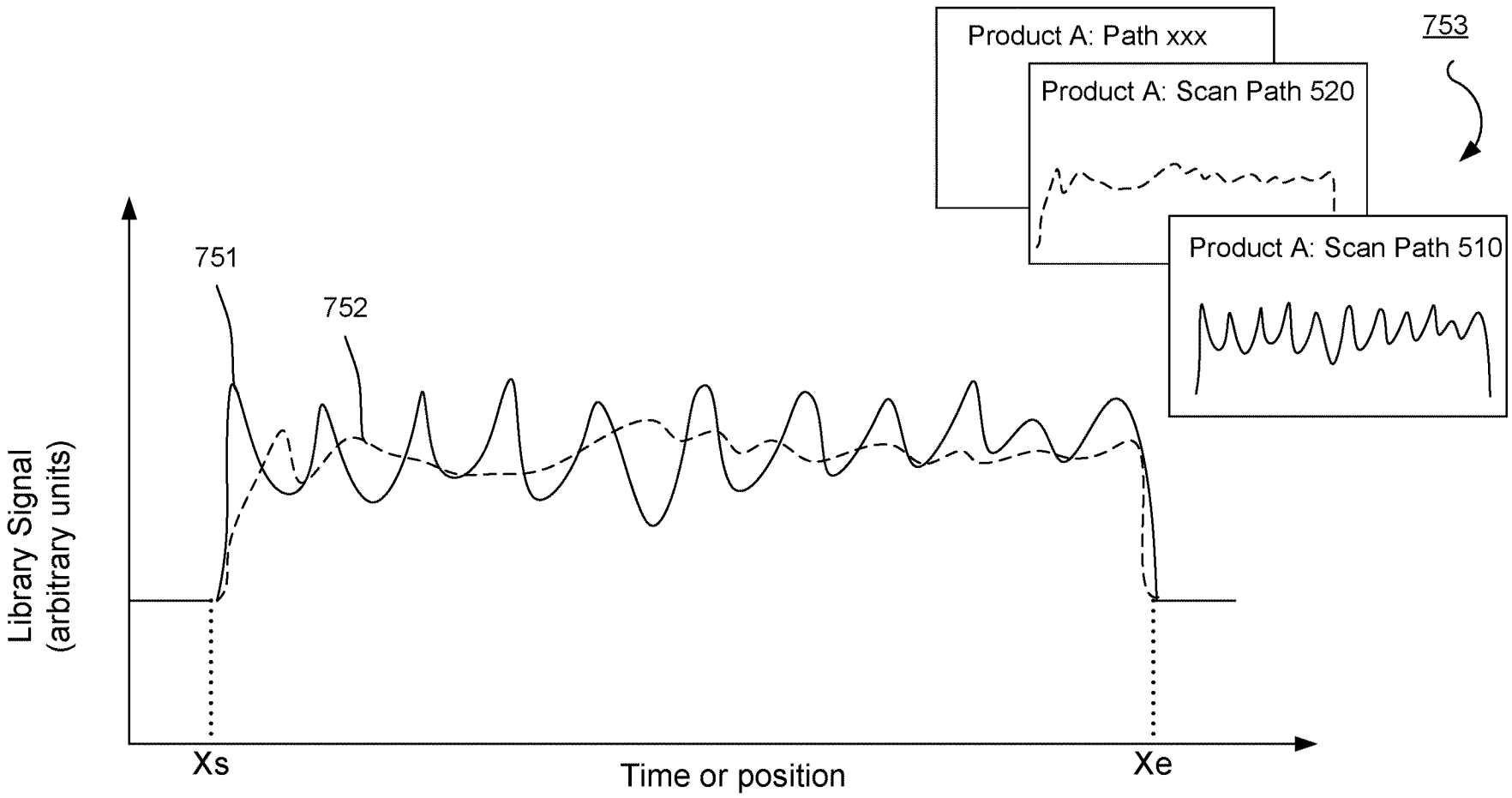
FIG. 7C is a schematic graph of background traces from two scan paths.

Assuming the library of background traces is properly generated, the corresponding background trace would be the one generated using the same scan path as the measured scan trace. For example, FIG. 7C illustrates the background traces derived from two distinct scan paths. Specifically, the background trace 751 originates from the scan path 510 from the first scan (e.g., label #1), and will be the corresponding background trace for the first measured trace 711 (e.g., also label #1). Similarly, the second background trace 752 is generated from the scan path 520 from the second scan (e.g., label #2), and thus will the corresponding background trace for the measured signal trace 712 (e.g., also label #2).

The controller 190 subtracts (604) the background trace with the equivalent label from the measured trace to generate a modified trace. The subtraction process is executed on a scan-to-scan basis with equivalent positions in the sequence of signal traces. For example, returning to FIGS. 7A and 7C, the background signal trace 751 is subtracted from the measured signal trace 711 because they share the same position, #1, in the sequence of traces; likewise, the background signal trace 752 is subtracted from the measured signal trace 712 due to their equivalent position, #2. If there are a total of n scans, this identical subtraction process is carried out for each scan.

The measured signal trace and the background signal trace can have the same labeling system. For example, both measured signal traces and background signal traces can be labeled based on its ordinal position within the sequence of traces. An ordinal position of each trace in the sequence of traces can be provided by ordering of the data. For example, as noted above, the background trace 751 and the measured signal trace 711 can be labeled #1 because they are the first entry in the sequence of traces, generated from the first scan path 510; the background trace 752 and the measured signal trace 712 can be labeled #2 because they are the second entry in the sequence of traces, generated from the second scan path 520.

The subtraction can be conducted immediately after each sensor scan or following a specified number of sensor scans, which can be defined within the controller 190. For example, if the subtraction is set to be conducted immediately after each scan, then following the first scan path, the background signal trace produced by the scan path #1 is retrieved from the library and then subtracted from the measured signal trace for the scan path #1; likewise, after the second scan path, the background signal trace produced by the scan path #2 is retrieved and then subtracted from the measured signal trace for the scan path #2, and so on.

If the specified number of scans is set to 2, which means that the subtraction is done after every 2 sensor scans, but the subtraction is still performed on a scan-to-scan basis. For example, after the first scan #1, a subtraction is not performed; but after the second scan #2, the background signal traces for both scan path #1 and #2 are retrieved together from the library. The background signals are then subtracted from the measured signal traces respectively on scan-by-scan basis, that is, background signal #1 is subtracted from measured signal trace #1, background signal #2 is subtracted from measured signal trace #2.

In some implementations, the apparatus 100 can be configured to allow for changes in the number of scans required prior to subtraction at different stages of the polishing, making it adaptable to varying conditions. For example, the apparatus 100 can be set to perform subtraction after every 5 scans at the beginning of a polishing process, when initial film thickness deviates significantly from a target thickness. As the polishing progresses, especially when measured thickness approaches the target thickness, the apparatus 100 can change to perform the subtraction immediately after each scan for more timely calculation.

In some implementations, the polishing system 100 has at least one notch finding station 200 to measure an angular orientation of the substrate 10 prior to polishing. By measuring the angular orientation of the substrate prior to polishing, the substrate 10 substrate can be rotated a specified angular position. Consequently, the positioning of the substrate notch or flat is consistent before each polishing process commences.

Referring to FIG. 5C, which is a schematic top view of a CMP polishing station, the controller 190 causes the carrier head 140 to rotate the substrate 10 prior to polishing to an angular orientation where the substrate notch or flat 509 is positioned at a particular predetermined angular position in the stationary frame of reference, e.g., the frame of reference of the base that holds the substrates. For example, the predetermined angle θ1, can be relative to an axis 195 that passes through both the axis of rotation 122 of the platen 120 and the center 197 of the carrier head 140. In some implementations, this axis can pass through the fixed-position sensor 188. The controller 190 can be configured such that' the notch or flat of each substrate to be polished is consistently aligned at this specified angular position before the polishing process begins for that substrate.

The controller 190 is also configured to rotate the platen 120 to a specified angular position before commencing polishing of the substrate 10. The sensor head 181 can be fixed on the rotating platen 120 such that the sensor head 181 rotates with the platen 120. This predetermined angular position, θ2, as depicted in FIG. 5C, can be relative to the axis 195.

With both the platen and the substrate consistently beginning at specific angular positions, the sensor head 181 should follow a consistent series of paths across the substrate on a substrate-to-substrate basis. Returning to FIG. 5B, provided that the relative angular position between the substrate 10 and the sensor head 181 remains consistent from one substrate to another, the initial scan path 510 can consistently commence at the path start position 512 and conclude at the path ending position 513 for each substrate, while for the second scan, the scan path 520 can consistently commence at the path start position 522 and conclude at the path ending position 523 for each substrate. Likewise, for the third, fourth and subsequent scans, the starting and ending positions of each path would also remain consistent from one substrate to another. Consequently, for equivalent positions within the sequence of scans, the sensor's path exhibits repeatability from substrate to substrate.

Referring back to FIG. 7C, if each consecutive background trace, e.g., traces 751 and 752, is generated with the same angular alignment as the corresponding measured traces, e.g., traces 711 and 712, they will trace the same scan paths 510 and 520. This angular alignment of the substrate 10 and the platen 120 before polishing results in a more accurate subtraction of the underlying signal trace on a scan-by-scan basis.

Figure 7D:
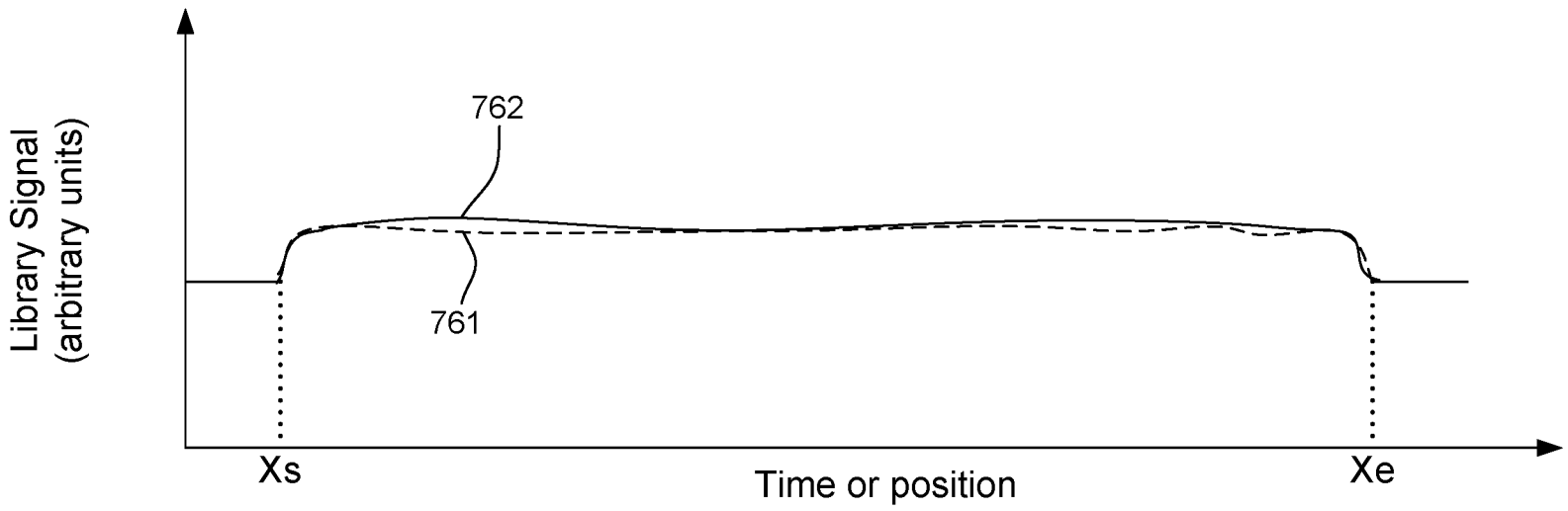
FIG. 7D is a schematic graph of two modified traces after subtracting background traces on a scan-by-scan basis.

For example, FIG. 7D illustrates modified signal traces using background signal subtractions on a scan-by-scan basis, when both the platen 120 and the substrate 10 consistently begin at specified angular positions. For example, the modified signal trace 761 is obtained by subtracting the background signal 751 from the measured signal 711, while the modified signal trace 762 is obtained by subtracting the background signal 752 from the measured signal trace 712. Employing background subtraction on a scan-by-scan basis, the modified signal traces offer more accurate representation of ground truth values for the target layer (see FIGS. 7B and 7D).

As noted above, the polishing apparatus 100 can include three polishing stations 110. The substrate notch alignment can be done at each notch finding station 200*a*, 200*b*, 200*c* prior to polishing at the next polishing station 110*a*, 110*b*, 110*c*, respectively (see FIG. 1). Similarly, each polishing station 110 can have an encoder 125 that measures the angular position or rotation rate of the associated drive shaft 126, and a motor 124 that can turn a drive shaft 126 to rotate the platen 120 to a specified angular position prior to polishing (see FIG. 2).

The specified angular position can vary among different polishing stations 110 and notch finders 200. Specifically, three polishing stations 110*a*, 110*b*, 110*c*, may each employ a distinct angular alignment for the substrate 10 and the platen 120. Nevertheless, the angular positioning needs remain consistent from one substrate to another for the same polishing station 110.

Figure 8:
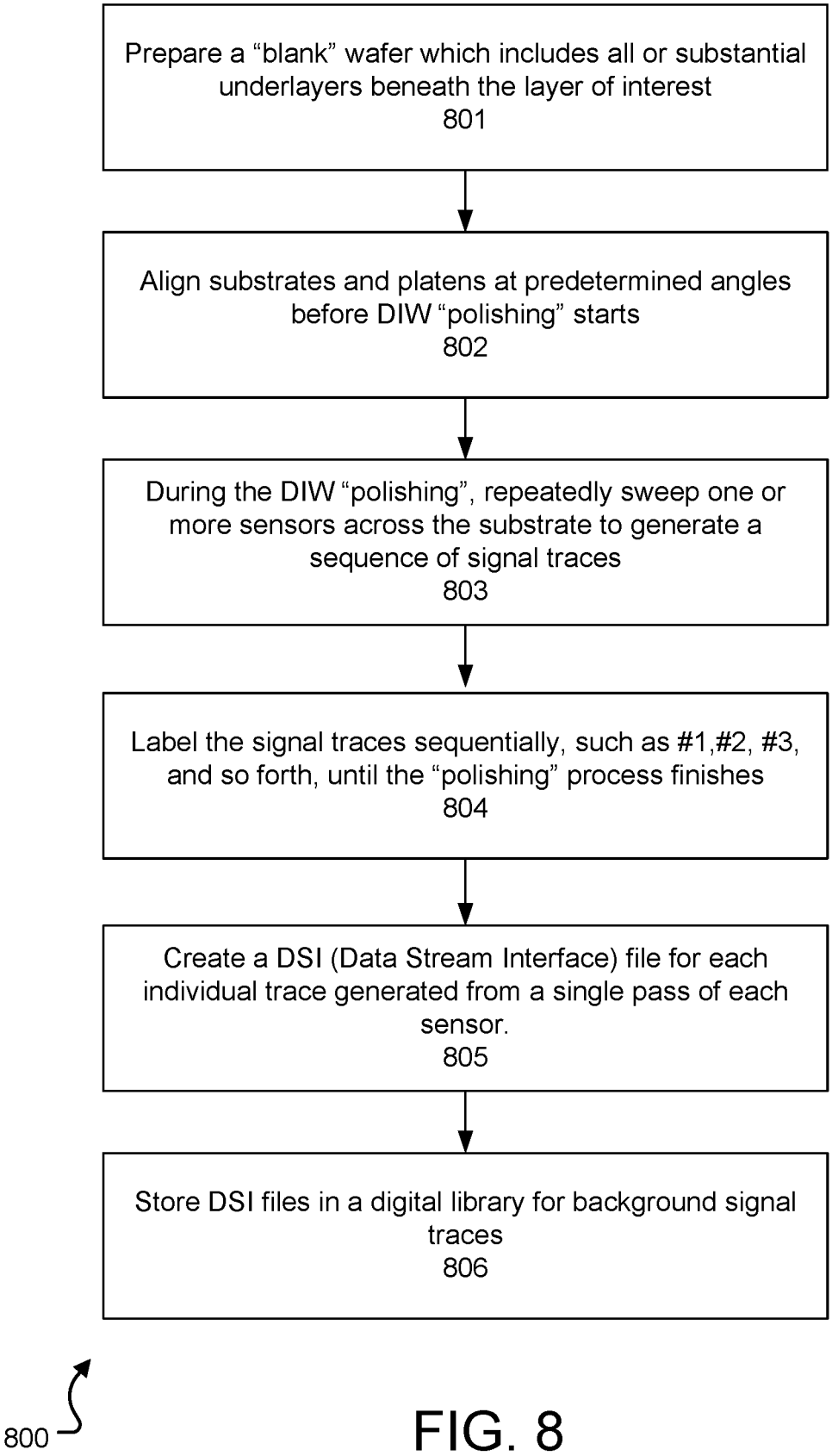
FIG. 8 is a flow diagram of an example process for generating a digital library storing background traces.

FIG. 8 is a flow-diagram of an example for creating a background signal library.

A calibration substrate is prepared (801) to include the same underlayers and the same pattern beneath the layer of interest, as a production substrate. The calibration substrate can either excluding the layer of interest itself, or have the layer of interested remaining only in trenches in an exposed layer. For example, a calibration substrate having the same pattern and including the same layers as a production substrate can be prepared, and then polished until the underlying layer is exposed.

This calibration substrate is used to establish a background signal library for the layer of interest; it need not be intended for use in production of integrated circuits. The calibration substrate can be created by processing all or a substantial portion of the underlayers on a substrate until reaching the layer of interest. Alternatively, the calibration substrate can be obtained by polishing a substrate with all layers (including the layer to be polished in production) until the underlying layer is exposed. A unique calibration substrate will be needed for each product, as different products have different patterns with distinct underlayer layouts and metal configurations, and thus will generate different background traces.

The controller 190 causes the carrier head 140 and platen 120 to rotate to position (802) the wafer notch or flat 509 of the calibration substrate and the platen 120 at their respective predetermined angular positions.

The platen 120 rotates to repeatedly sweep (803) one or more sensors across the substrate to generate a sequence of background traces during a "simulated polishing" process. In this simulated polishing process, the carrier head and platen rotate at the same speeds and the carrier had rotates at the same rate as will occur during regular polishing of a product substrate. However, deionized water (DIW) is utilized in place of slurry for dispensed liquid 164 (see FIG. 2), ensuring that no actual polishing of the "calibration substrate" occurs. In other words, the thickness of the exposed top layer of the "calibration substrate" should remain unchanged throughout the "simulated polishing" process. In addition, the pressure in the carrier head can be reduced, e.g., the chambers can be vented to atmosphere, to avoid polishing.

Process parameters for polishing the calibration substrate are set to mirror those of a real polishing process, including, but not limited to, platen 120's rotation rate, substrate 10's rotation rate, the angular positions of platen 120. The "polishing" duration can be set equal to or longer than that of a real polishing process to encompass all potential unique scan paths generated during a real polishing process. Consequently, for a given product, the total number of background traces in the digital library may equal or exceed that of an actual polishing on a production substrate.

The controller 190 labels (804) the background traces sequentially from each sensor, such as #1, #2, #3, and so forth, until the "simulated polishing" process finishes. As noted above, alternative labeling methods can also be utilized.

The controller 190 stores (805) each individual background trace. The stored background traces provide a library of background traces. In some implementations, each trace is stored as a separate digital file. If there are a total of n traces generated throughout the entire "simulated polishing" process, then there will be a total of n files, with labels from #1 to #n. The file format includes, but not limited to, Data Stream Interface (DSI) file.

In some implementations, there are two or more sensors of the in-situ monitoring system 180 which are supported on the rotating platen 120. Each sensor can travel a distinct path within a single rotation of the platen, and the labeling of the signal traces is specific to each sensor and each scan path. Therefore, a signal trace's position in the sequence of measured traces is contingent upon both the sensor and the scan path it follows. To illustrate, if there are three sensors, and each sensor generates 100 scan paths over the entire polishing process, a total of 300 signal traces would be created, and these can be sequentially labeled from #1 to #300. Consequently, corresponding background traces for the given product are also generated using the same configuration of three sensors, resulting in a digital library with a minimum of 300 traces. When performing scan-by-scan subtraction, the subtraction process involves matching the position in the sequence of background traces and measured traces to produce a sequence of 300 modified traces.

In some implementations, where multiple sensor heads are supported on the platen, a scan averaging method can be employed to consolidate the modified traces collected from the multiple within a single platen rotation. Using the example mentioned earlier, for each platen rotation, three sensors generate three measured signal traces. By subtracting the background signal trace on a scan-by-scan basis from these three measured signal traces, three modified signal traces are obtained. Subsequently, the average of these three modified signal traces is computed, resulting in a single averaged modified signal trace. This averaged trace represents the mean value for that particular platen rotation. If the entire polishing process comprises a total of 100 platen rotations, this scan averaging method would yield 100 averaged traces. These 100 averaged traces are then used to calculate the instant thickness of the substrate 10. In conjunction with scan-by-scan subtraction method, this scan averaging method can further diminish background noise originating from underlayers.

In addition or alternatively, a scan averaging method can be applied prior to the subtraction of background signals. Specifically, an averaged trace is generated by averaging the measured traces gathered from different sensors within a single platen rotation, and then the corresponding background trace is subtracted from the averaged traces. To illustrate using the previously mentioned example, for each platen rotation, three sensors produce three measured signal traces. Before subtraction the average of these three measured signal traces is firstly computed, yielding a single averaged signal trace. Subsequently, the respective background trace is subtracted from this averaged signal trace to yield a modified signal trace. The respective background trace can be obtained by averaging the three corresponding background traces. In other words, the subtraction is achieved by deducting an averaged background trace from an averaged measured signal for each platen rotation. The resulting modified signal trace is then employed to calculate the instant thickness of the substrate 10.

When both the carrier head 140 rotation rate and the platen 120 rotation rate remain constant throughout the polishing process, under ideal circumstances, scan paths may repeat themselves after a specific number of scans. However, if there is a loosened mechanical connection between the substrate 10 and its carrier head 140, as illustrated in FIG. 5D, it can lead to horizontal oscillations 199 of the substrate 10 relative to its carrier head 140 during the polishing operation. This oscillation 199, in turn, causes a displacement in the scan traces.

Figure 10A:
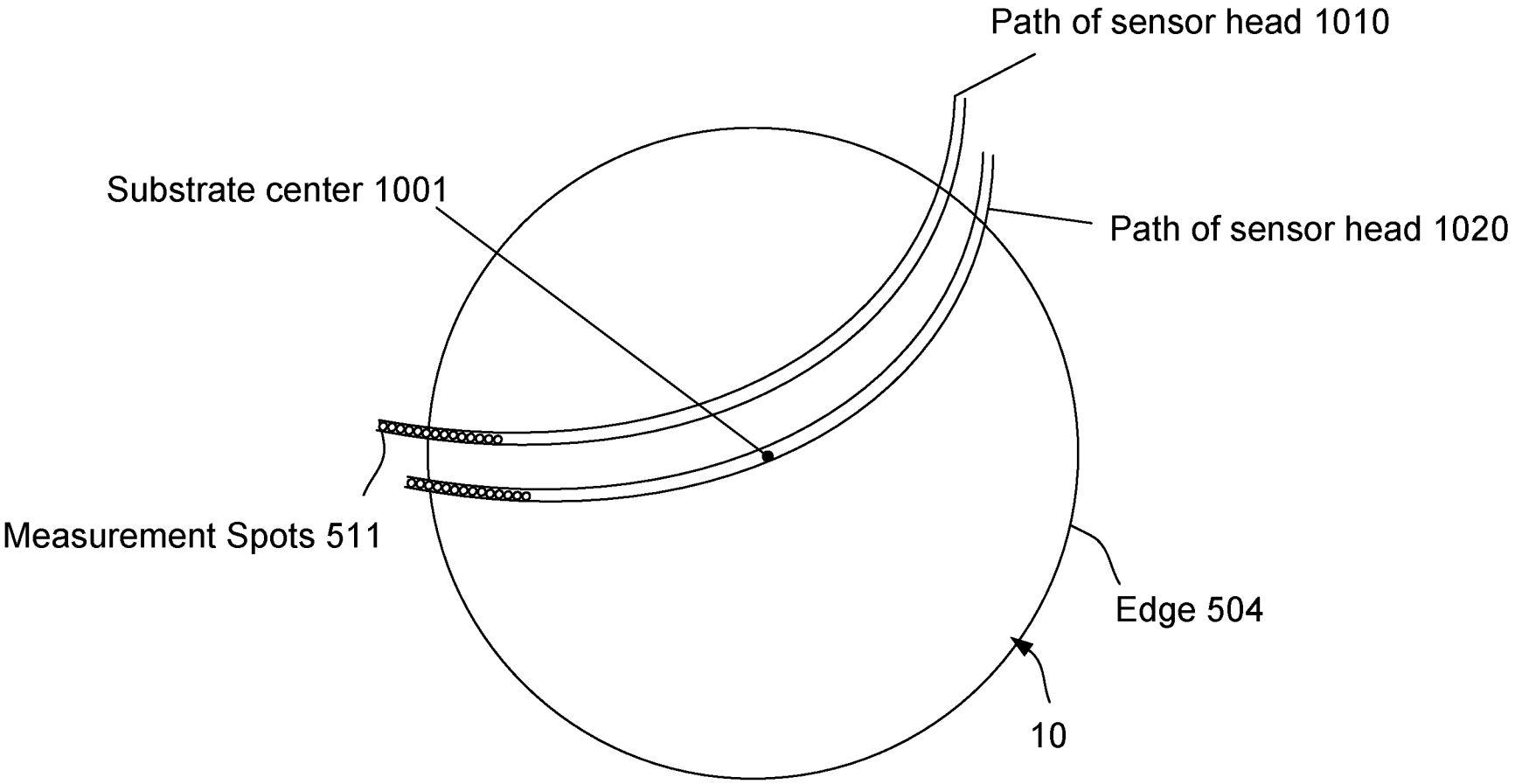
FIG. 10A is a schematic top view illustrating a shift in sensor scan paths.

FIG. 10A illustrates an example of the path displacement from scan path 1010 to scan path 1020 due to loosened mechanical connection. Because of this displacement, the path 1020 travels through the substrate center 1001 and covers a greater distance than the path 1010. Consequently, the path 1020 experiences a longer scanning time compared to path 1010.

Figure 10B:
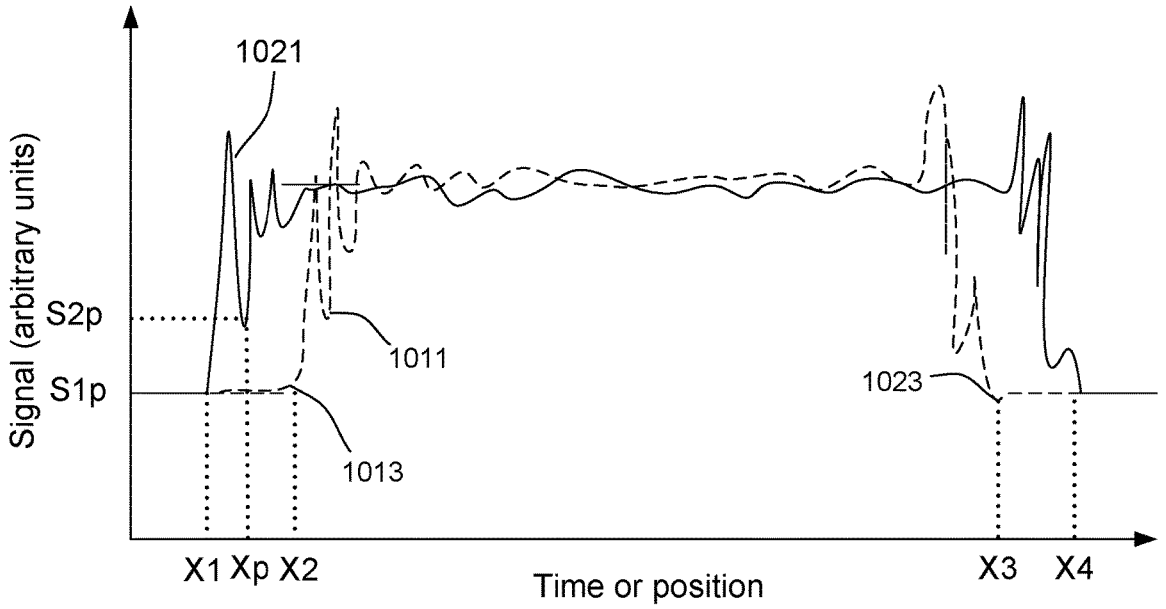
FIG. 10B is a schematic graph illustrating a shift in scan traces along the x-axis.

Referring to FIG. 10B, the X-axis on the graph can be a measurement time or a position, e.g., radial position, of the measurement on the substrate. The scan signal trace 1021 is generated by the scan path 1020, starting at X1 and ending at X4. The scan signal trace 1011 is generated by the scan path 1010, starting at X2 and ending at X3. Due to the shorter distance covered by the scan path 1010, the duration of its signal trace (X3-X2) is also shorter in comparison to the duration of the signal trace 1021 (X4-X1).

Within this context, Xp is an arbitrary point located between X1 and X2. S2*p* signifies the measurement taken at the substrate edge region 503 for the signal trace 1021, while S1*p* is the off-substrate measurement for the signal trace 1011 at Xp (i.e., signals generated when the sensor head scans areas beyond the edge 504 of the substrate 10). This situation can introduce challenges when applying a scan-by-scan subtraction and/or scan averaging method at Xp, because S1*p* represents an off-substrate measurement that holds no meaningful value in the calculation of signals for the substrate 10.

In some implementations, the scan-by-scan subtraction method is conducted on signal traces that share the same time or position. For example, as illustrated in FIGS. 7A, 7C and 7D, both signal traces (711,712) and background traces (751, 752) start at the same time or position denoted as Xs and end at the same time or position denoted as Xe. Consequently, the modified signal traces (761, 762) maintain the same time or position.

Figure 10C:
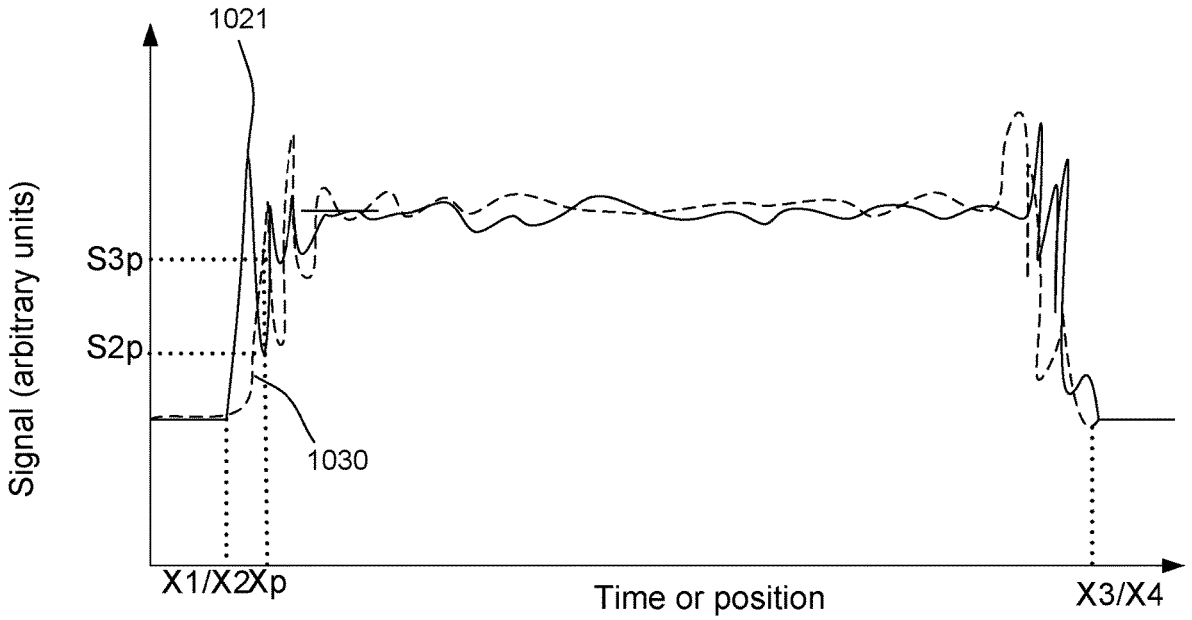
FIG. 10C is a schematic graph of a scaled trace aligned with an unscaled trace along the x-axis.

In some implementations, a scaling trace is utilized to ensure that each trace spans from the same starting time or position to the same ending time or position. For example, referring to FIG. 10C, the scaled signal trace 1030 is derived by scaling the signal trace 1011 along the x-axis in a manner that aligns its starting and ending points with those of signal trace 1021, specifically matching X2 to X1 and X3 to X4. The scaling can be conducted using methods, including without limitation a Min-Max scaling. The Min-Max scaling method scales the original value to a specific range using the following formular for each data point x, x_scaled=(x−min_original)*(max_new−min_new)/(max_original−min_original)+min_new, where x is the original data point; min_original and max_original are the minimum and maximum values in the original range; min_new and max_new are the minimum and maximum values in the new range.

Subsequently, the scan-by-scan subtraction and/or the averaging method is applied to both the signal trace 1021 and the scaled signal trace 1030. For example, at the time or position Xp, S3*p* represents the scaled signal value originating from the signal trace 1011, and S2*p* represents the unscaled signal value from the signal trace 1021. Specifically, when considering signal trace 1021 as a "measured" signal trace and signal trace 1030 as a scaled "background" trace derived from the same scan path, the scan-by-scan background subtraction can be expressed as S3*p*-S2*p* at Xp.

In addition or alternatively, the polishing apparatus 100 can detect a leading edge of the trace and a trailing edge of the trace. For example, in FIG. 10B, the edge 1013 corresponds to the leading edge of the signal trace 1011, while the edge 1023 corresponds to the trailing edge of the signal trace 1011. The polishing apparatus 100 can be configured to detect such edges.

In some implementations, the polishing apparatus 100 can apply edge reconstruction. Edge construction refers to the process of controlling and optimizing the removal of material at the edges of a substrate during the polishing process. The edge of a substrate can present unique challenges during CMP because it is more susceptible to non-uniform material removal and damage compared to the central region. Edge construction can involve various techniques and strategies to achieve uniformity and minimize edge defects.

In some implementations, the edge reconstruction employs a neural network, as described in U.S. Patent Publication Nos. 2018-0304435. As illustrated in FIG. 4B, the variation in the signal intensity in the portions 422, 426 is caused in part by measurement region of the sensor overlapping the substrate edge, rather than an intrinsic variation in the thickness or conductivity of the layer being monitored. Consequently, this distortion in the signal 401 can cause errors in the calculating of a characterizing value for the substrate, e.g., the thickness of the layer, near the substrate edge.

To address this problem, the controller 190 can include a neural network to generate a modified signal corresponding to one or more locations of the substrate 10 based on the measured signals corresponding to those locations. The neural network is configured to, when trained appropriately, generate modified signals that reduce and/or remove the distortion of computed signal values near the substrate edge. The system obtains estimated measures of thickness generated by the neural network based on input values that include measured signals for each location in a group of locations of the substrate. The system also obtains ground truth measures of thickness for each location in the group of locations. The system can generate ground truth measures of thickness using an electrical impedance measuring method, such as the four-points probe method.

The system then computes a measure of error between the estimated measures of thickness and the ground truth measures of thickness and updates one or more parameters of the neural network based on the measure of error. If the polishing apparatus uses such a neural network to generate modified signals based on the measured signals generated by the in-situ monitoring system, the apparatus can compensate for the distortions, e.g., reduced signal strength, at the substrate edge.

Referring back to FIG. 6, after obtaining modified signal traces using various signal processing methods as mentioned above, the controller 190 calculates (605) estimated thickness values based on modified traces. Each estimated thickness value represents the thickness of the layer being polished at the time the measured trace was acquired.

Figure 9:
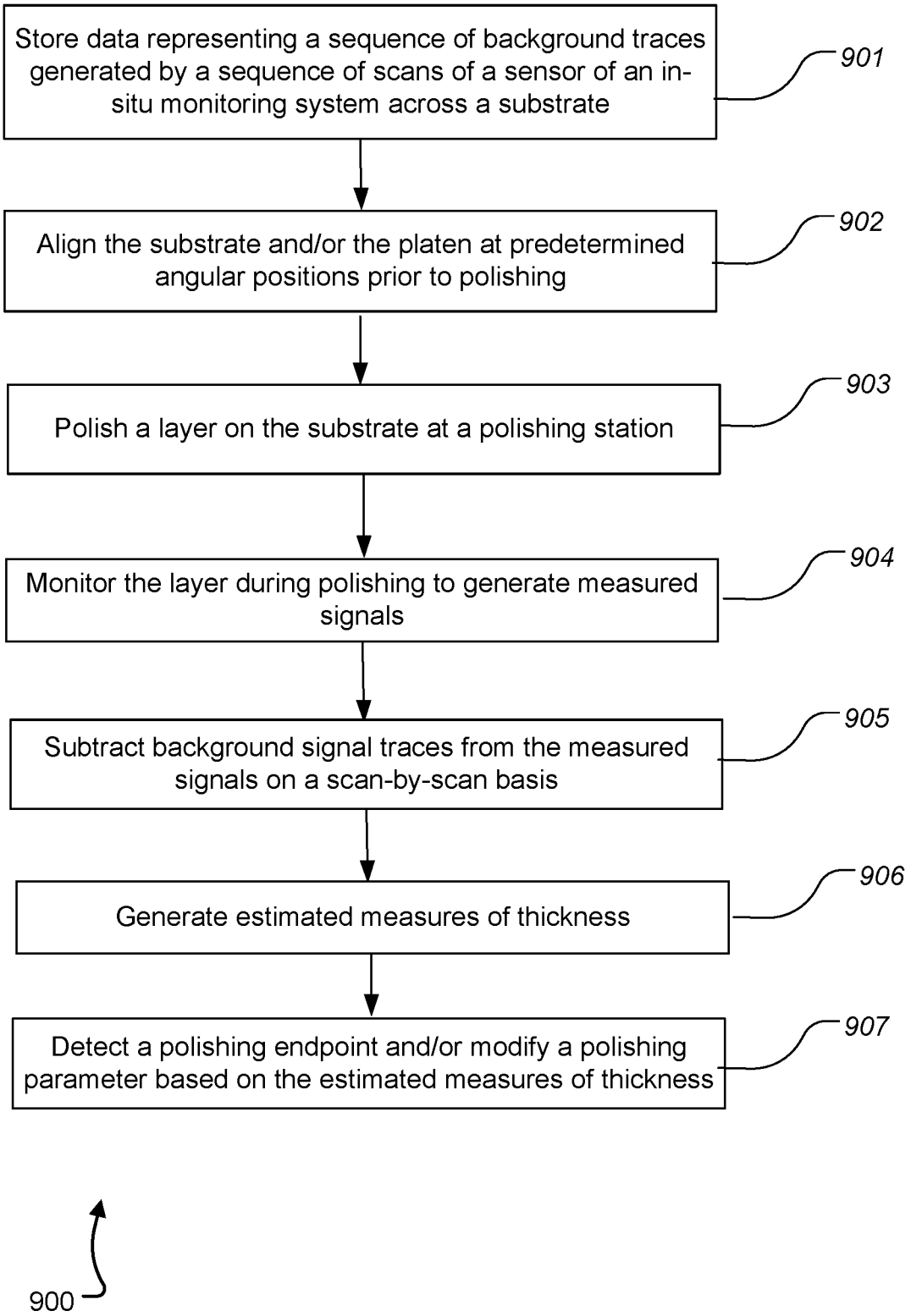
FIG. 9 is a flow diagram of an example process for polishing a substrate.

As illustrated in FIG. 4A, for a given modified signal value, the polishing apparatus 100 can use the correlation curve 404 to generate a corresponding thickness value. The correlation curve 404 can be considered a "static" formula, in that it predicts a thickness value for each modified signal value regardless of the time or position at which the sensor head obtained the signal. The correlation curve can be represented by a variety of functions, such as a polynomial function, or a look-up table (LUT) combined with linear interpolation. With the correlation curve 404, a sequence of estimated thickness values can thus be generated using modified signal values. Each thickness profiling includes thickness values as a function of time or radial position on the substrate 10, as illustrated in FIG. 7A. FIG. 9 is a flow-diagram of an example process 900 for polishing a substrate 10.

A sequence of background traces generated by a sequence of scans of one or more sensors across a substrate are stored (901), e.g., in a memory of the controller 190. An example process for generating a digital library of background traces is given in FIG. 8.

The substrate 10 and the platen 120 are positioned at respective predetermined angular positions prior to polishing (902). The polishing apparatus 100 polishes (903) a layer on the substrate 10 and monitors (904) the layer during the polishing to generate measured signal values for different locations on the layer, e.g., using the in-situ monitoring system 180.

Background traces are subtracted from the measured signal traces on a scan-by-scan basis (905). As described above, this can include determining the background trace that has the same ordinal position in the scanning sequence as the measured trace, and subtracting that background trace from the measured trace. As noted above, this scan-by-scan subtraction method can be further combined with other signal processing methods, such as, a scan averaging method by taking an average of multiple signal traces, a neutral network configured to generate modified signals that reduce the distortion of computed signal values near the substrate edge, scaling the signal trace to match position such that each trace extends along a same start time or position to a same end time or position, etc.

An estimated measure of thickness is generated (906) for each location of the different locations based on the measured signal for the location.

A polishing endpoint is detected and/a polishing parameter is modified (907) based on each estimated measures of thickness.

The monitoring system can be used in a variety of polishing systems. Either the polishing pad, or the carrier head, or both can move to provide relative motion between the polishing surface and the substrate. The polishing pad can be a circular (or some other shape) pad secured to the platen, a tape extending between supply and take-up rollers, or a continuous belt. The polishing pad can be affixed on a platen, incrementally advanced over a platen between polishing operations, or driven continuously over the platen during polishing. The pad can be secured to the platen during polishing, or there can be a fluid bearing between the platen and polishing pad during polishing. The polishing pad can be a standard (e.g., polyurethane with or without fillers) rough pad, a soft pad, or a fixed-abrasive pad.

Although the discussion above focuses on an eddy current monitoring system, the correction techniques can be applied to other sorts of monitoring systems, e.g., optical monitoring systems. In addition, although the discussion above focuses on a polishing system, the correction techniques can be applied to other sorts of substrate processing systems, e.g., deposition or etching systems, that include an in-situ monitoring system with a sensor that scans across the substrate.

A number of embodiments of the invention have been described. Nevertheless, it will be understood that various modifications may be made without departing from the spirit and scope of the invention. Accordingly, other embodiments are within the scope of the following claims.

What is claimed is:

1. A method of generating a sequence of reference traces for use in in-situ monitoring, the method comprising:

measuring an angular orientation of a calibration substrate;

rotating a carrier head holding the calibration substrate to a first predetermined angular position based on the measured angular orientation;

rotating a platen to a second predetermined angular position;

bringing the calibration substrate into contact with a polishing pad on the platen with calibration substrate at the first predetermined angular position and the platen at the second predetermined angular position;

rotating the platen and the carrier head with the calibration substrate in contact with the polishing pad;

monitoring the calibration substrate by sweeping a sensor of an in-situ monitoring system across the calibration substrate to generate a sequence of reference traces with each respective reference trace of the sequence of reference traces corresponding to a respective sweep of a sequence of sweeps by the sensor, and wherein each reference trace includes a series of signal values; and storing the sequence of reference traces and labelling each reference trace to distinguish an order of the reference traces within the sequence.

2. The method of claim 1, comprising conducting the monitoring of the calibration substrate with substantially no polishing occurring.

3. The method of claim 2, comprising flushing a polishing surface of the polishing pad with a cleaning liquid to remove slurry from the polishing surface before bringing the calibration substrate into contact with a polishing pad.

4. The method of claim 2, comprising venting a chamber in the carrier head holding the calibration substrate while the calibration substrate is in contact with the polishing pad.

5. The method of claim 1, wherein the in-situ monitoring system comprises an eddy current monitoring system.

6. The method of claim 5, wherein scanning the scanning the sensor across the calibration substrate generates a raw signal trace, and comprising converting the raw signal trace to the reference trace using a correlation curve.

7. The method of claim 6, wherein the correlation curve is calibrated to convert raw signal values to thickness values for a conductive layer, and the calibration substrate is not covered by the conductive layer.

8. The method of claim 6, wherein converting the raw signal trace to the reference trace using the correlation curve generates a preliminary reference trace, and comprising performing edge reconstruction on each preliminary reference trace to generate the reference trace.

9. The method of claim 8, wherein performing edge reconstruction includes including processing portions of the preliminary trace corresponding to an edge of the calibration substrate through a neural network.

10. The method of claim 1, comprising counting a number of rotations of the platen to provide an ordinal position of the reference trace in the sequence of reference traces and labelling the reference trace with ordinal position.

11. The method of claim 1, comprising scaling the reference traces such that each reference trace extends from a same start time or position to a same end time or position.

12. The method of claim 11, comprising detecting a leading edge of the reference trace and a trailing edge of the reference trace.

13. The method of claim 1, comprising fabricating the calibration substrate by depositing an outer conductive layer over one or more underlying layers below the outer conductive layer, and polishing the outer conductive layer until an underlying layer from the one or more underlying layers is exposed, such that the reference traces are background traces resulting from monitoring of a substrate that is not covered by the outer conductive layer.

14. The method of claim 1, comprising fabricating the calibration substrate by depositing one or more underlying layers on a substrate, and generating the sequence of reference trace before depositing an outer conductive layer on the one or more underlying layers.

15. A computer program product computer program product residing on a non-transitory computer readable medium and comprising instructions for causing one or more computers to:

receive a measurement of an angular orientation of a calibration substrate;

cause a carrier head holding the calibration substrate to rotate to a first predetermined angular position based on the measured angular orientation;

cause a platen to rotate a second predetermined angular position;

cause the calibration substrate to be brought into contact with a polishing pad on the platen with calibration substrate at the first predetermined angular position and the platen at the second predetermined angular position;

cause the platen and the carrier head to rotate with the calibration substrate in contact with the polishing pad;

receive a sequence of reference traces from an in-situ monitoring system with each respective reference trace of the sequence of reference traces corresponding to a respective sweep of a sequence of sweeps by a sensor of the in-situ monitoring system across the calibration substrate, and wherein each reference trace includes a series of signal values; and store the sequence of reference traces and labelling each reference trace to distinguish an order of the reference traces within the sequence.

16. The computer program product of claim 15, comprising instructions to cause a polishing surface of the polishing pad to be flushed with a cleaning liquid to remove slurry from the polishing surface before bringing the calibration substrate into contact with a polishing pad.

17. The computer program product of claim 15, comprising instructions to cause a chamber in a carrier head holding the calibration substrate to be vented while the calibration substrate is in contact with the polishing pad.

18. The computer program product of claim 15, comprising instructions count a number of rotations of the platen to provide an ordinal position of the reference trace in the sequence of reference traces and labelling the reference trace with ordinal position.

19. The computer program product of claim 15, comprising instructions to convert a raw signal trace from the sensor to a preliminary reference trace using a correlation curve.

20. The computer program product of claim 19, comprising instructions to perform edge reconstruction on the preliminary reference trace to generate the reference trace.

* * * * *